US007677900B2

(12) United States Patent
Crighton

(10) Patent No.: US 7,677,900 B2
(45) Date of Patent: Mar. 16, 2010

(54) BACK-TO-BACK MOUNTED ELECTRICAL CONNECTORS

(75) Inventor: Alan David Crighton, Apex, NC (US)

(73) Assignee: FCI Americas Technology, Inc., Carson City, NV (US)

( * ) Notice: Subject to any disclaimer, the term of this patent is extended or adjusted under 35 U.S.C. 154(b) by 0 days.

(21) Appl. No.: 12/168,431

(22) Filed: Jul. 7, 2008

(65) Prior Publication Data

US 2009/0075494 A1 Mar. 19, 2009

Related U.S. Application Data

(60) Provisional application No. 60/972,964, filed on Sep. 17, 2007.

(51) Int. Cl.
*H01R 12/00* (2006.01)

(52) U.S. Cl. ..... 439/62

(58) Field of Classification Search ..... 439/62, 439/326–329, 636, 637

See application file for complete search history.

(56) References Cited

U.S. PATENT DOCUMENTS

| | | | | |
|---|---|---|---|---|
| 4,984,996 | A * | 1/1991 | Watanabe et al. | 439/326 |
| 5,080,611 | A | 1/1992 | Hypes | |
| 5,921,812 | A | 7/1999 | Choy | |
| 6,903,940 | B2 * | 6/2005 | Ta | 361/788 |
| 6,904,482 | B2 * | 6/2005 | Rietze et al. | 710/107 |
| 7,111,211 | B1 * | 9/2006 | Co et al. | 714/718 |
| 2005/0243533 | A1 * | 11/2005 | Malone et al. | 361/801 |
| 2005/0270875 | A1 * | 12/2005 | Saeki | 365/222 |

* cited by examiner

*Primary Examiner*—Jean F Duverne
(74) *Attorney, Agent, or Firm*—Woodcock Washburn LLP

(57) ABSTRACT

An electrical connector assembly is provided that includes a pair of connectors configured to be mounted onto a midplane circuit board in a back-to-back orientation. Each connector includes offset engagement members that mate with corresponding engagement members on the midplane circuit board.

21 Claims, 20 Drawing Sheets

BACK-TO-BACK MOUNTED ELECTRICAL CONNECTORS

CROSS REFERENCE TO RELATED APPLICATIONS

This claims the benefit of U.S. Provisional Patent Application Ser. No. 60/972,964 filed Sep. 17, 2007, the disclosure of which is hereby incorporated by reference as if set forth in its entirety herein.

FIELD OF THE DISCLOSURE

The present invention generally relates to electrical connectors, and in particular relates to an electrical connector assembly having electrical connectors mounted on opposing sides of a midplane circuit board.

BACKGROUND OF THE DISCLOSURE

An electronic system, such as a server, for example, may include components mounted on printed circuit boards, such as daughtercards, backplane boards, motherboards, midplane boards, and the like, that are interconnected to transfer power and data signals throughout the system. A typical midplane connector assembly may include electrical connectors disposed on opposite sides of a midplane circuit board, such that the electrical connectors are in electrical communication with each other. The electrical connectors may in turn be connected to a motherboard, daughtercard, backplane, and the like.

In some connector systems, there is a need to electrically connect an electronic component (e.g., daughtercard, etc.) positioned on one side or surface of a midplane circuit board to a corresponding electronic component (e.g., daughtercard, etc.) positioned on an opposite side or surface of the midplane circuit board. In one approach, pins from two contact modules extend into matching holes (i.e., the same through-hole or via) in a midplane circuit board. One set of pins extends into the holes from one side of the midplane circuit board, and the other set of pins extends into the same set of holes from the other side of the midplane circuit board. In another approach, only one pin is inserted into each hole in the midplane. Each of the single pins extends beyond the first and second surfaces of the midplane, and the pins receive plastic headers.

Such a configuration of matching holes or using common holes in the printed circuit board to provide electrical communication between two connectors may have disadvantages, such as requiring a thicker midplane than otherwise necessary. As such, there is a need for alternative configurations to overcome such disadvantages.

SUMMARY OF THE DISCLOSURE

In accordance with one aspect of the present invention, an electrical connector is configured to be attached to a midplane circuit board. The electrical connector includes a chassis that is elongate in a first direction and that further extends along a second direction perpendicular to the first direction. The chassis defines a slot that is configured to receive an edge of an electrical component. The electrical connector further includes a plurality of electrical contacts that are configured to be electrically connected between the electrical component and the midplane circuit board. First and second engagement members extend out from the chassis in a third direction orthogonal to the first and second directions. The engagement members are offset with respect to both the first and second directions.

DETAILED DESCRIPTION OF ILLUSTRATIVE EMBODIMENTS

Figure 1:
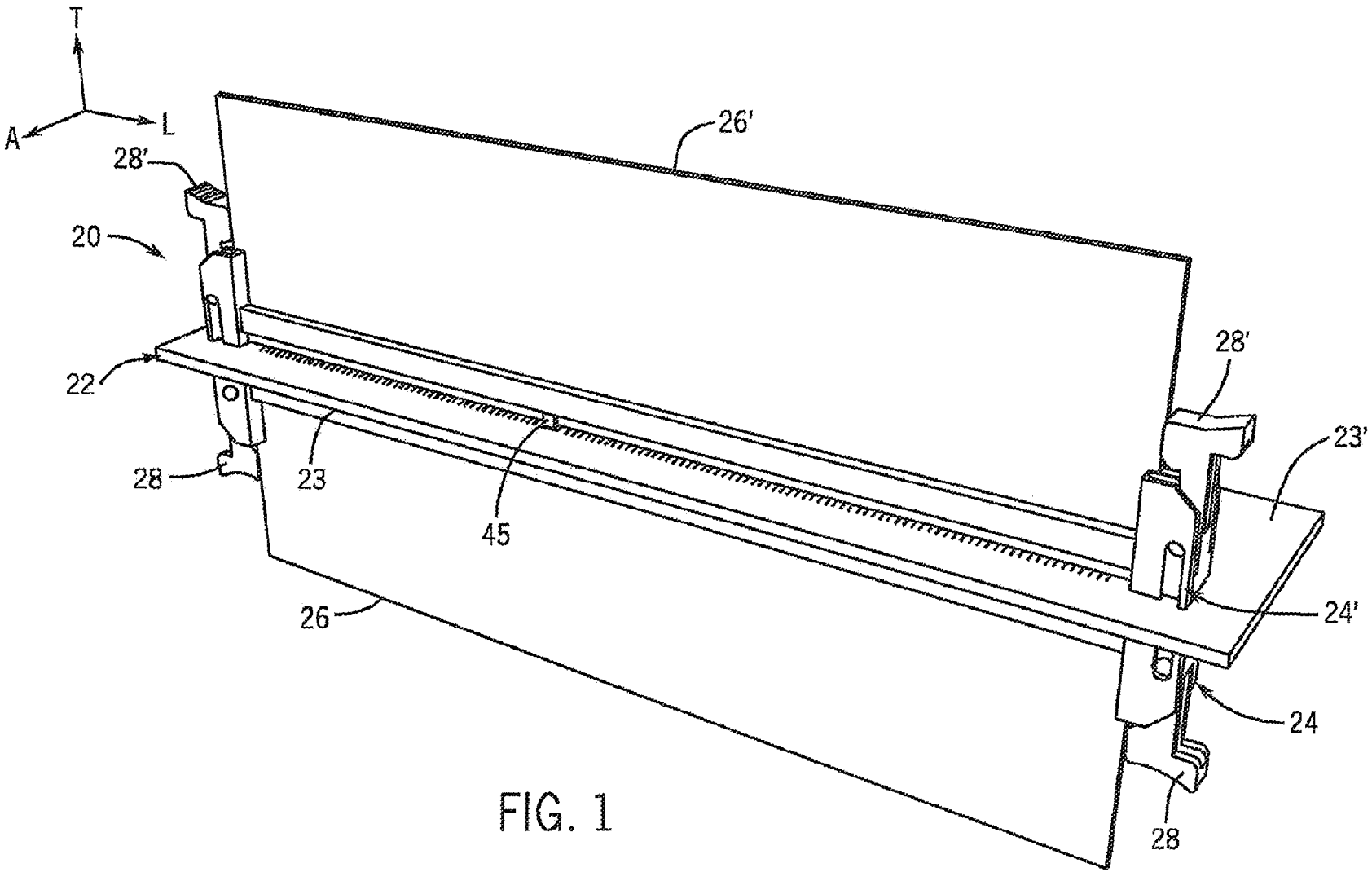
FIG. 1 is a perspective view of a midplane connector assembly including a pair of aligned electrical connectors attached back-to-back to opposite sides of a midplane circuit board, and showing the connectors each further attached to an electrical component, illustrated as a printed circuit board.

Referring to FIG. 1, an electrical connector assembly, such as a midplane connector assembly 20, includes a substrate in the form of a midplane circuit board 22, and a first and second electrical connector 24 and 24' attached to opposite sides the midplane circuit board 22. The midplane circuit board 22 includes a first surface 23 configured to interface with the first connector 24, and a second opposing surface 23' configured to interface with the second connector 24'. In the illustrated orientation, the first surface 23 defines a lower surface, while the second surface 23' defines an upper surface. The midplane circuit board 22 can include one or more differential signaling paths, one or more single-ended signaling paths, or a combination of differential signaling paths and single-ended signaling paths (not shown) configured to facilitate electrical communication between the electrical connectors 24 and 24'. The midplane circuit board 22 may also include one or more ground paths (not shown), which may be electrically connected to each other by traces and/or ground planes. A signaling path and a ground path can each include an electrically conductive trace that is in electrical communication with an electrically conductive pad or with an electrically conductive via.

Each connector 24 and 24' can be in the form of a press-fit type card-edge connector for mounting onto a substrate, such as the midplane circuit board 22. The connectors 24 and 24' can each be configured to accept and attach to a corresponding electrical component, such as a printed circuit board 26 and 26' such that the printed circuit board 26 and 26' are in electrical communication through the midplane circuit board 22. As illustrated, the connector 24 is connected between the lower surface 23 of the midplane circuit board 22 and the printed circuit board 26, which depends down from the midplane circuit board 22. The connector 24' is connected between the upper surface 23' of the midplane circuit board 22 and the printed circuit board 26', which extends upward from the midplane circuit board 22. As illustrated, the connectors 24 and 24', and hence the printed circuit boards 26 and 26', can be mounted onto the midplane circuit board 22 in a back-to-back orientation, as will be described in more detail below.

The printed circuit boards 26 and 26', respectively, can each be a daughter card of any type, and as illustrated can each be provided as a memory module such as a very low-profile (VLP) double data rate (DDR2), including the DDR3 memory module assembly. Each connector 24 and 24' can include a pair of latches 28 that are operable between a locked position that retains the associated circuit boards 26 and 26', and an unlocked position to facilitate removal of the respective printed circuit board circuit board from its associated connector.

Unless otherwise specified, the present invention is not intended to be construed as being limited to double data rate modules, as the principles of the present invention are applicable to any connectors that can be mounted back-to-back on a midplane circuit board and connected to a desired daughter card. Furthermore, while the description herein of one circuit board 26 can be applicable to the opposing circuit board 26', it should be appreciated that the circuit boards 26 and 26' can be similarly or dissimilarly constructed.

The connector assembly 20 extends along a longitudinal direction L, and a lateral direction A that can be orthogonal to the longitudinal direction L. As illustrated, the longitudinal direction L and lateral direction A extend horizontally, though the present invention recognizes that the orientation of the midplane circuit board 22 may vary during use, which could cause the lateral direction A and longitudinal direction L to extend vertically, or at an angle with respect to the vertical or the horizontal. Throughout this description, the lateral direction A and longitudinal direction L are referred to as horizontal directions for the purposes of clarity and illustration, though the present invention is not intended to be limited to this directional configuration.

The midplane connector assembly 20 further extends along a transverse direction T, which can extend orthogonal to the longitudinal direction L and lateral direction A. Throughout this description, therefore, the transverse direction T is referred to as a vertical direction for the purposes of clarity and illustration. However, it should be appreciated that the actual orientation associated with the transverse direction T will vary during use depending, for instance, on the orientation of the midplane circuit board 22. Accordingly, though the directional terms "horizontal" and "vertical" are used for the purposes of clarity and illustration, components described in combination with horizontal and vertical directions as illustrated may not extend horizontally and vertically, respectively, during use.

While the connectors 24 and 24' are illustrated as right angle connectors, it should be understood by one having ordinary skill in the art that the present invention is not intended to be limited to this specific connector configuration. Rather, certain aspects of the present invention contemplate any connector suitable for being mounted back-to-back with another connector onto a midplane circuit board for connection to an electronic device in the manner described herein. For instance, certain aspects of the present invention contemplate the use of right-angle connectors, mezzanine-style connectors, vertical connectors, or the like. Accordingly, any such connector is therefore intended to fall within the scope of the present invention unless otherwise specified. Furthermore, the connectors may be substantially identical as shown, or alternatively can be different style connectors.

The connectors 24 and 24' will now be described with respect to the connector 24, it being appreciated that the directional terms such as "up" and "down" and the like are used in reference to the illustrated orientation of the connector assembly 20, including the described connector 24. Because the connectors 24 and 24' are illustrated as being substantially identical, a description pertaining to one of the connectors is equally applicable to the other connector unless otherwise specified. It should further be appreciated that because the connectors 24 and 24' are arranged in different orientations (upside down with respect to each other, as illustrated), the directional terms "up" and "down" and derivatives thereof used with respect to the described connector 24 may correspondingly differ when applied to the opposing connector 24' as mounted onto the midplane circuit board 22.

Figure 2:
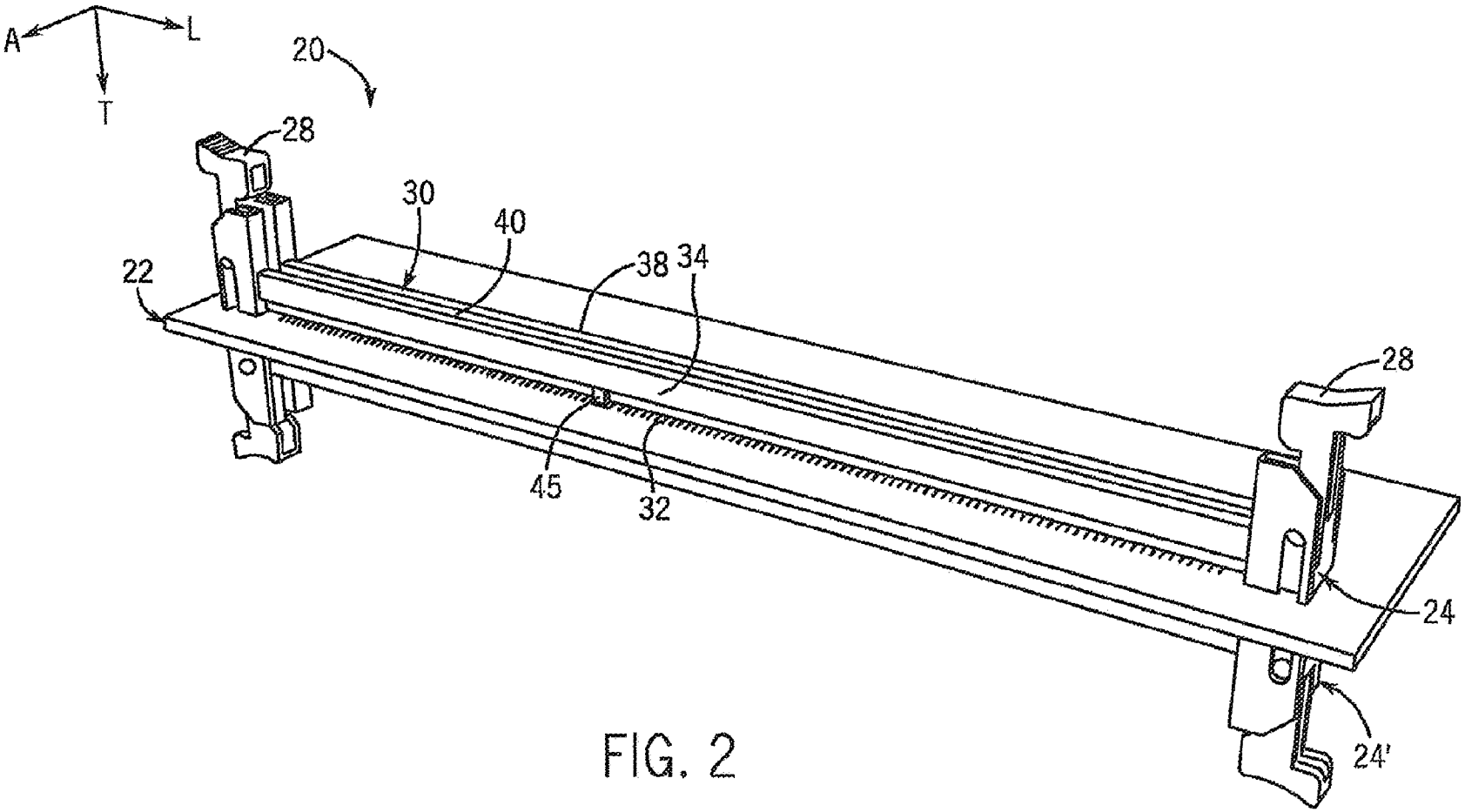
FIG. 2 is a perspective view of the midplane connector assembly illustrated in FIG. 1 in an inverted orientation with respect to FIG. 1, showing the midplane connector assembly unattached to the printed circuit boards.
Figure 3:
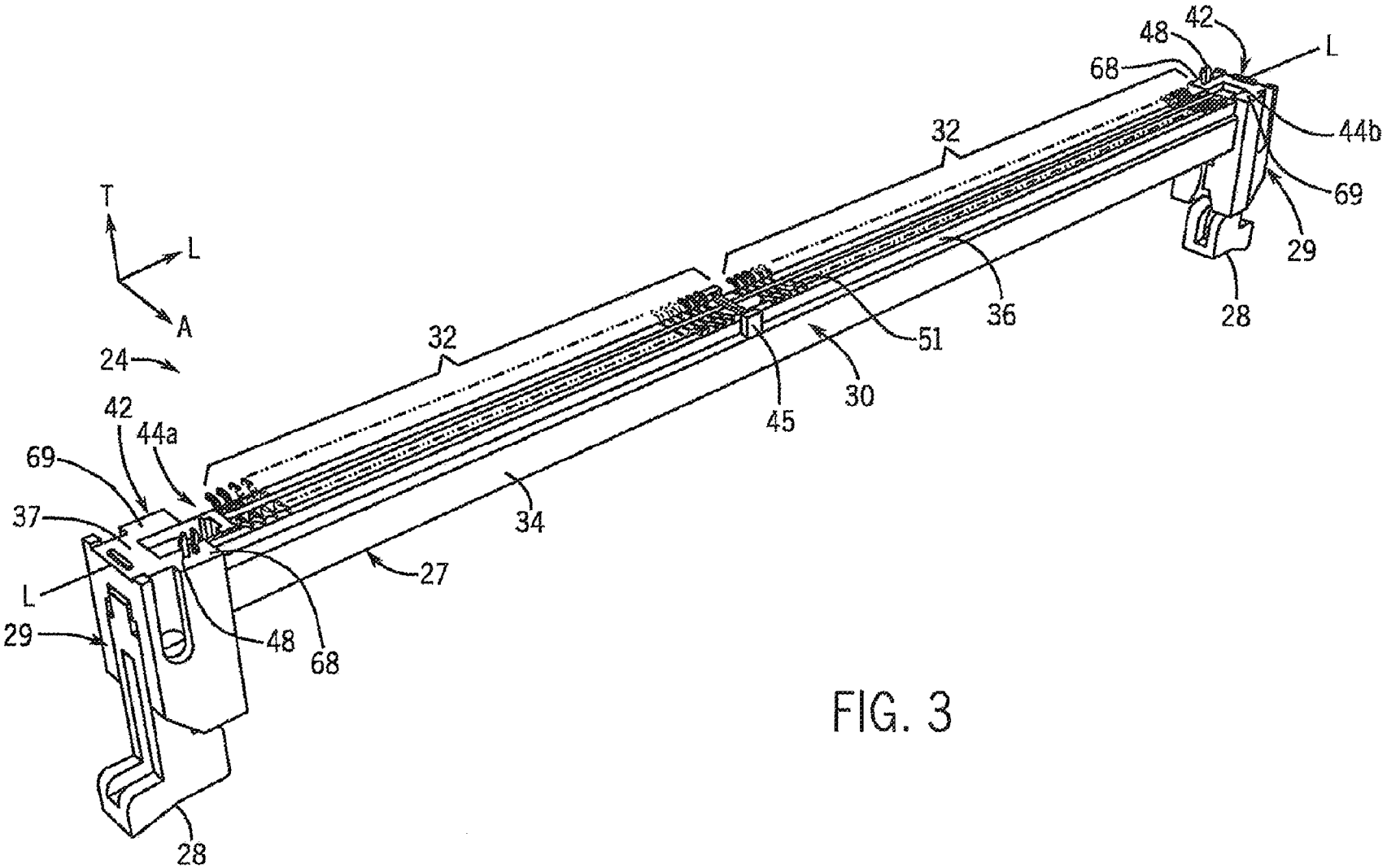
FIG. 3 is a perspective view of one of the electrical connectors illustrated in FIG. 1.

The connector assembly 20 is illustrated in FIG. 2 in a vertically inverted orientation with respect to the illustration in FIG. 1 to better illustrate the connector 24. Referring now to FIGS. 2-3, the connector 24 can include a connector housing 27 that that can be formed from a dielectric material, such as polymer such as plastic, thermoplastic, or the like. The connector housing 27 can be manufactured using any suitable technique, such as injection molding for example. The housing 27 includes a chassis 30 that can mechanically secure a plurality of longitudinally spaced electrically conductive contacts 32 that are configured to connect the midplane circuit board 22 to the associated corresponding memory module assembly 26. The chassis 30 can further retain the contacts 32 in a desired position and electrically insulate between the contacts 32 with a dielectric material, such as air or plastic, or combinations thereof.

The chassis 30 can be elongate in the longitudinal direction L, and can also extend along the lateral direction A and the transverse direction T so as to define a rectangular profile. Specifically, the chassis 30 can include a pair of longitudinally elongate opposing side walls 34 and a base 36. The base 36 is configured to face, or abut, the lower surface 23 of the midplane circuit board 22 when the connector 10 is mounted onto the circuit board 22. The chassis 30 further includes an upper end 38 disposed opposite the base 36. A key 45 can project down from the chassis at a location off-center with respect to the longitudinal direction. The key can engage a corresponding key, such as an aperture (not shown), supported or defined by the midplane circuit board 22 to ensure that the connector 24 is mounted onto the circuit board 22 in a desired orientation. The chassis 30 defines a longitudinally elongate slot 40 extending vertically downward into the upper surface 38.

Figure 4:
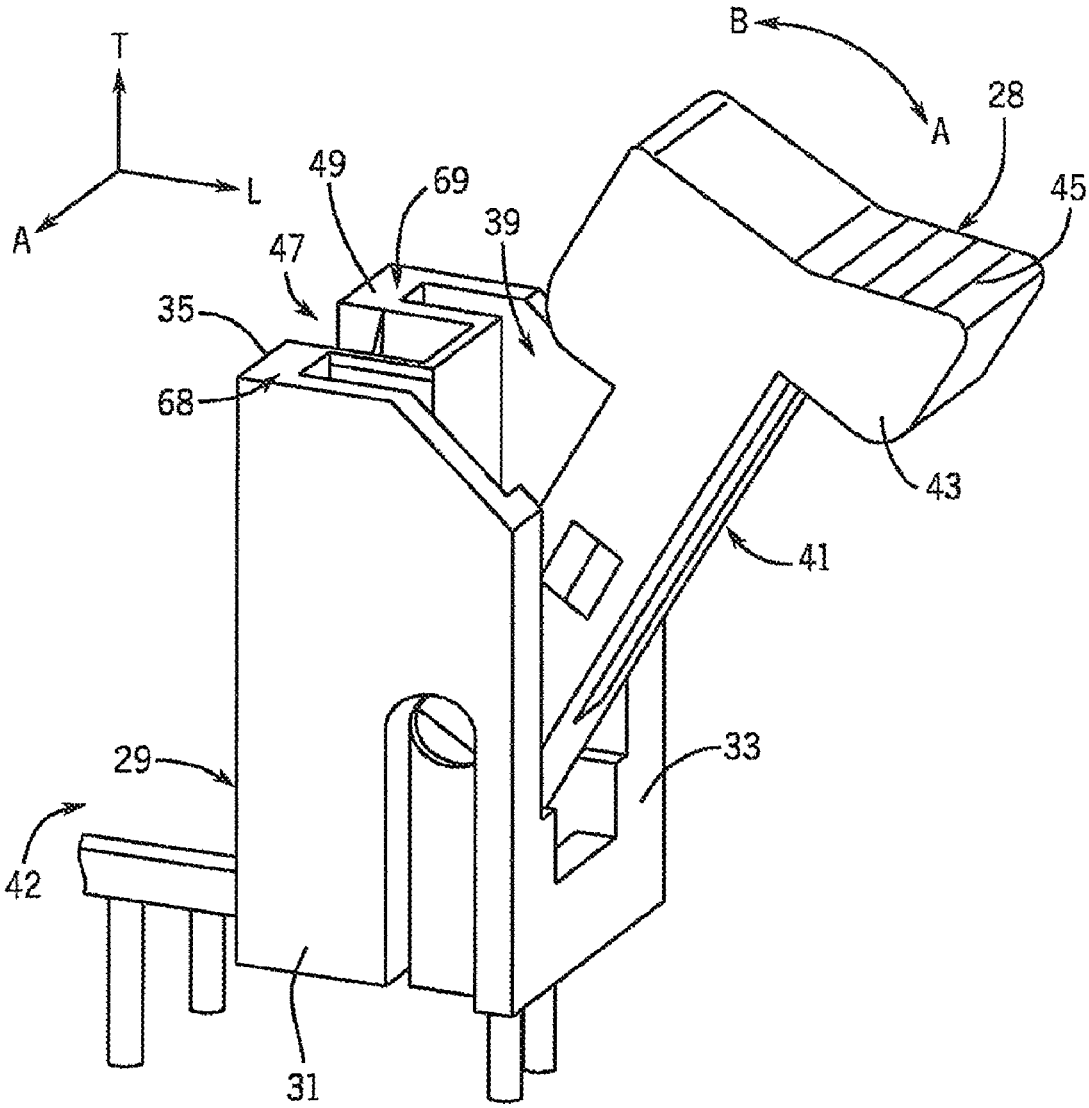
FIG. 4 is a perspective view showing a latch of one of the electrical connectors illustrated in FIG. 1 movable between a locked and an unlocked position.

Referring now also to FIG. 4, the connector housing 27 further includes a pair of opposing longitudinally outer end portions 42 disposed at opposing outer ends of the chassis 30 and positioned such that the slot 40 extends longitudinally between the end portions 42. Each end portion 42 carries a latch 28 that is operable to lock and unlock the slot 40 with respect to inserting and removing the associated circuit board 26. Each latch 28 is supported by a latch housing 29 that is affixed to, and thus supported by, the chassis 30. The latch housing 29 can include a pair of vertical side walls 31, a vertical end wall 33, a vertical front wall 35, a horizontal base 37 (see FIG. 5), and an opposing upper end 49. A rectangular pocket 47 can project into the front wall 35, and extend vertically through the base 37 and the upper end 49. The pocket 47 can have a lateral thickness substantially equal to the lateral thickness of the chassis 30 such that the longitudinally outer ends of the chassis 30 are disposed inside the pocket 47. The latch housing 29 can include a pair of laterally spaced posts 68 and 69 disposed on opposite lateral sides of the pocket 47. The latch housing 29 can define an opening 39 that projects longitudinally into the end wall 33, and extends vertically through the upper end 49. The opening terminates at a location above the base 37.

A latch actuator can be provided in the form of a latch arm 41 that is pivotally connected to the latch housing 29 at a pivot location, and extends up from the pivot location into the opening 39. The latch arm 41 can include a longitudinally extending handle 43 that presents an upper gripping surface 46 configured for manual engagement. The latch arm 41 can thus pivot with respect to the latch housing 29 about a laterally extending pivot axis (not shown) along an angular direction indicated by Arrow A from a vertical locked position (shown in FIG. 2) toward and an unlocked position (shown in FIG. 3) that is offset from the vertical. The latch arm 41 can pivot along an angular direction indicated by Arrow B that is opposite the direction of Arrow A from the unlocked position toward the vertical locked position. When in the locked position, the latches 28 can engage retaining features on the printed circuit board 26 to secure the circuit board 26 in the slot 40. When the latches 28 are in their unlocked position, the circuit board 26 can be removed from and either re-inserted into the slot 40 or replaced by another desired electrical component circuit board which can be inserted into the slot 40.

With continuing reference to FIG. 3, the electrical contacts 32 of the connector 24 can be arranged in a pair of laterally spaced connector rows 44*a* and 44*b*. As illustrated, the row 44*a* is juxtaposed with one of the side walls 34, and the row 44*b* is juxtaposed with the opposing side wall 34. Each contact 32 of each row 44*a* and 44*b* has an upper end (not shown) that terminates within the slot 40. The upper ends of the contact 32 in each row 44*a* and 44*b* define a gap therebetween that is configured to receive the associated circuit board 26. The upper ends of the contacts 32 are aligned with, and thus connect to, complementary electrical traces carried by the received circuit board 26. Each contact 32 extends down from its upper end and through the base 36, and flares laterally outward along the base 36 toward the corresponding side wall 34 to define a lower end 51 that is configured to engage traces on the midplane circuit board 22.

The lower ends 51 of the contacts 32 can be attached to the midplane circuit board 22 in any manner appreciated by one having ordinary skill in the art. For instance, the lower ends 51 can be surface mounted via a solder connection onto the traces of the circuit board 22. Alternatively, the lower ends 51 can be provided as tails that are configured to be press-fit into corresponding apertures that extend into the circuit board 22 such that the contacts 32 connect to the complementary electrical traces on the board 22 (see FIGS. 15A-B). The lower ends 51 collapse horizontally within the aperture, thereby providing a press-fit engagement that retains the lower ends 51 within the corresponding apertures. Alternatively still, the lower ends 51 can configured to be through-mounted to the circuit board 22. Specifically, the lower ends 51 can pass through the board 22, and can be soldered to the backside of the circuit board 22. Unless otherwise specified, the scope of the present invention is not intended to be limited to any particular method or system of attachment of the contacts 32 to the midplane circuit board 22.

Figure 5:
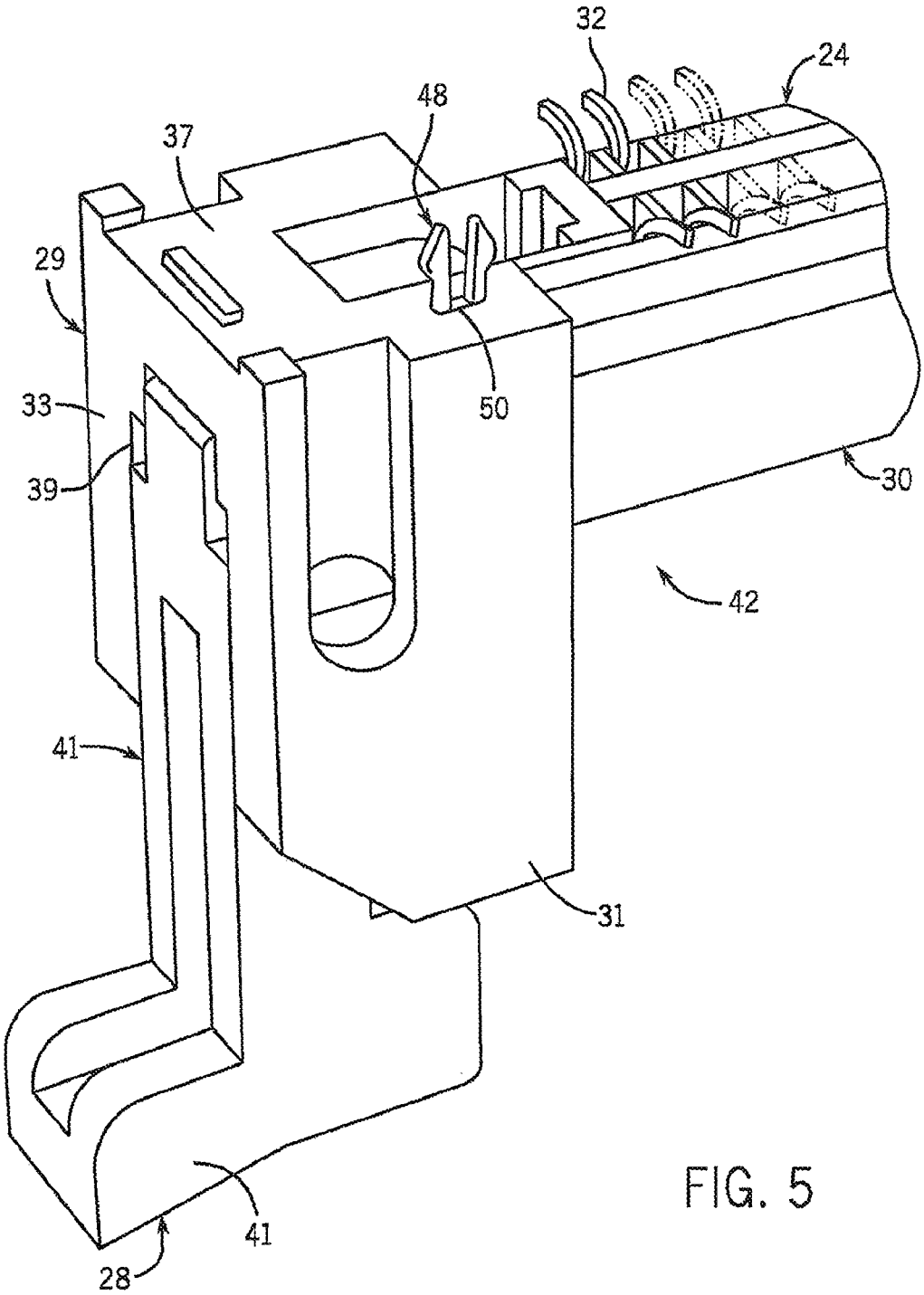
FIG. 5 is an enlarged perspective view of a fastening end of one of the connectors illustrated in FIG. 1.
Figure 6:
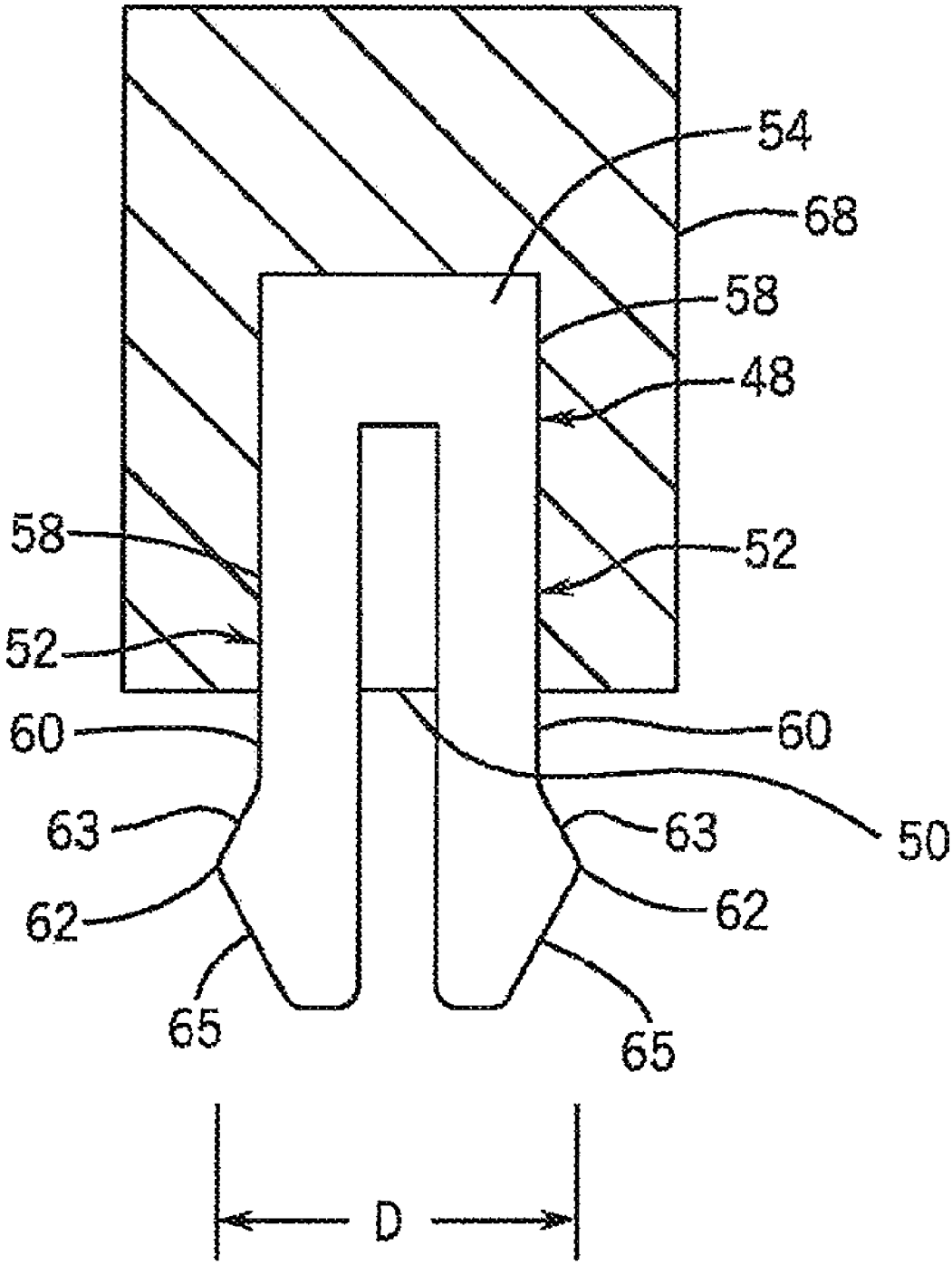
FIG. 6 is a sectional view of a portion of the fastening end of the connector illustrated in FIG. 5.
Figure 7:
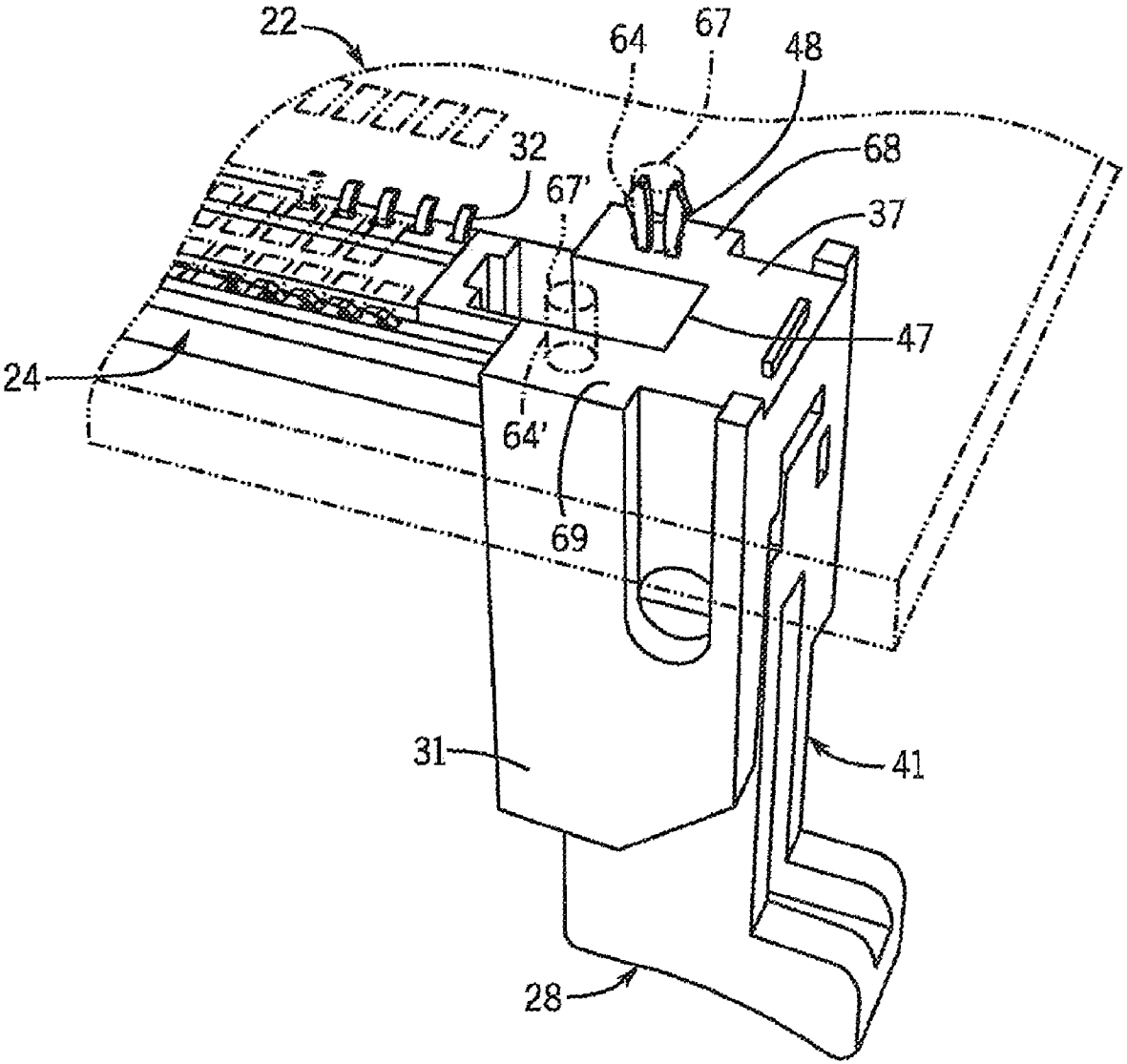
FIG. 7 is an enlarged perspective view of an outer end of the connector illustrated in FIG. 3 having an engagement member shown attached to a complementary engagement member of the midplane circuit board.

Referring now to FIGS. 5-7, the attachment of the connectors 24 and 24' to the midplane circuit board 22 will now be described with reference to the connector 24. Specifically, the connector 24 carries an engagement member 48 that is supported by each latch housing 29. It can also thus be said that the engagement member 48 is likewise supported by the chassis 30. In accordance with the illustrated embodiment, the engagement member 48 extends transversely from the post 68 of the latch housing 29. In particular, a recess 50 can extend vertically into the base 37 a distance less than the height of the side wall 31 such that the recess terminates within the latch housing 29. The engagement member 48 includes a pair of engagement pins 52 that are joined at a common base 54. The base 54 can be press-fit inside the recess 50, or can alternatively be fastened within the recess 50 using any suitable mechanical fastener, such as glue or the like. The base 54 is disposed in a longitudinally elongate orientation within the recess 50, and the engagement pins 52 extend down from opposing longitudinal ends of the base 54 such that a gap 56 is disposed between each the pins 52.

Each pin 52 thus defines a proximal end, or stem, 58 disposed within the recess 50, and a distal, or outer, end 60 that extends from the proximal end 58 and projects from the recess 50. The distal end 60 of each pin 52 carries a barb 62 that projects longitudinally outward such that the barbs 62 of each pin 52 extend in opposing directions and face away from each other. The barbs 62 define a first edge 63 that is angled outwardly from the pin 52, and a second edge 65 that is disposed downstream from the first edge 63. The second edge 65 is connected to the outer end of the first edge 63 and is angled inwardly from the first edge 63 to define an outer pin tip. The engagement pins 52 define an outer barb distance D that is illustrated as a longitudinal distance that extends between the outermost edges of the opposing barbs 62. It should be appreciated that the barbs 62 could extend in any desired direction that facilitates attachment to the midplane circuit board 22, as will now be described with reference to FIG. 7.

Specifically, the midplane circuit board 22 includes a plurality of engagement members 64 that each provides an engagement location 67 (see FIG. 11) configured to mate with a corresponding engagement member 48 of the connector 24. As illustrated, the midplane circuit board 22 includes a pair of the engagement members 64 and 64' in the form of apertures that extend into or through the circuit board 22. In the illustrated embodiment, each aperture 64 and 64' is transversely aligned with the respective engagement members 48 and 48' of the corresponding connector 24 and 24'. The aperture 64 and 64' can be cylindrical in shape, and can have a diameter slightly less than the outer barb distance D.

Accordingly, the connector 24 can be attached to the midplane circuit board 22 by inserting the engagement pins 52 into the corresponding aperture 64. Because the outer barb distance D can be slightly greater than the diameter of the aperture 64 when the engagement member 48 is in its relaxed position, interference between the opposing barbs 62 and the midplane circuit board 22 inside the aperture 64 causes the engagement pins 52 to flex toward each other from the relaxed position to a flexed position within the aperture 64. When the stems 58 are in the flexed position, each stem 58 exerts a spring force that biases the corresponding barb 62 against the board 22 at the perimeter of the aperture 64. The engagement member 48 can be made from any suitable metal or hard plastic such that the barbs 62 can dig into the board 22 at the perimeter of the aperture 64 to provide frictional resistance and mechanical interference to forces that would tend to separate the connector 24 and the board 22. The stem 58 thus has a length that is less than the transverse thickness of the midplane circuit board 22. Accordingly, the barbs 62 are disposed within the aperture 64 and do not extend past the opposing surface 23' when the connector 24 is fully attached to the midplane circuit board 22.

It should be appreciated that aperture 64 can assume any suitable shape having a dimension slightly less than the outer barb distance D such that the barbs 62 can engage the circuit board 22 inside the aperture 64 in the manner described above. In one example, the aperture 64 can include a counterbore such that the barbs 62 are inserted through a first diameter and extend into a second diameter greater than the first diameter, and the first edge 63 engages the portion of the latch housing 29 that defines the first diameter while the second edge 65 protrudes into that portion of the aperture 64 that defines the second larger diameter.

Figure 8:
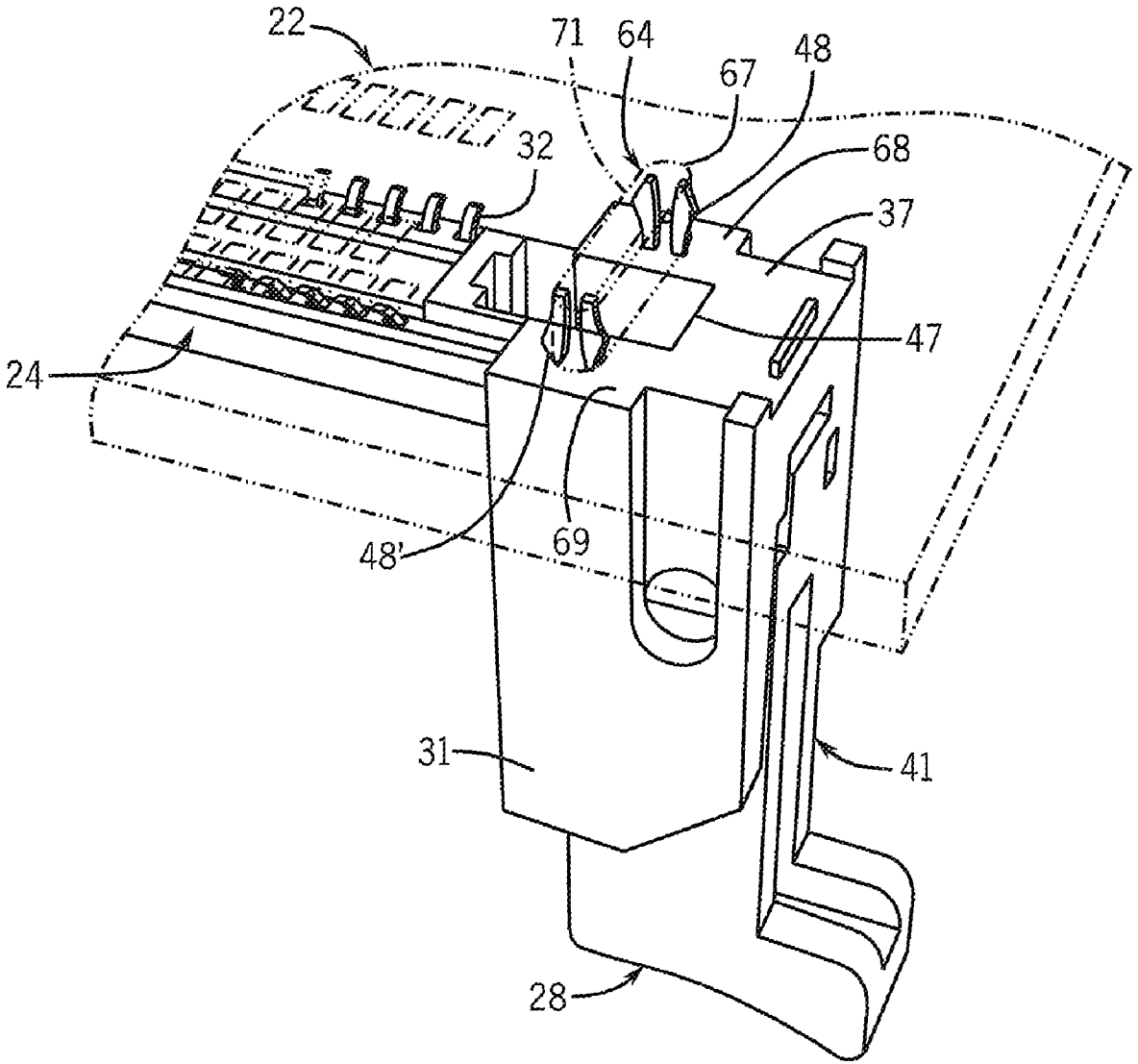
FIG. 8 is an enlarged perspective view similar to FIG. 7, but showing the engagement member of the midplane circuit board constructed in accordance with an alternative embodiment.

Referring now to FIG. 8, the connectors 24 and 24' can be attached to the midplane circuit board 22 in accordance with another alternative embodiment. Specifically, the engagement member 64 can be provided as a single aperture 71 that can extend vertically through the midplane circuit board 22. The single aperture 71 can be sufficiently laterally elongate to as to be in alignment with both engagement members 48 and 48' of the connectors 24 and 24'. The single aperture 71 can have a longitudinal thickness configured to receive both engagement members 48 and 48' at its opposing lateral ends in the manner described above with respect to apertures 64 and 64'.

Once the engagement member 48 is connected to the engagement member 64, the electrical traces 32 can be connected to the corresponding electrical traces on the midplane circuit board 22 using for instance solder reflow. It should thus be appreciated that each engagement member 64 provides an engagement location that is configured to attach to the connector 24.

Figure 9:
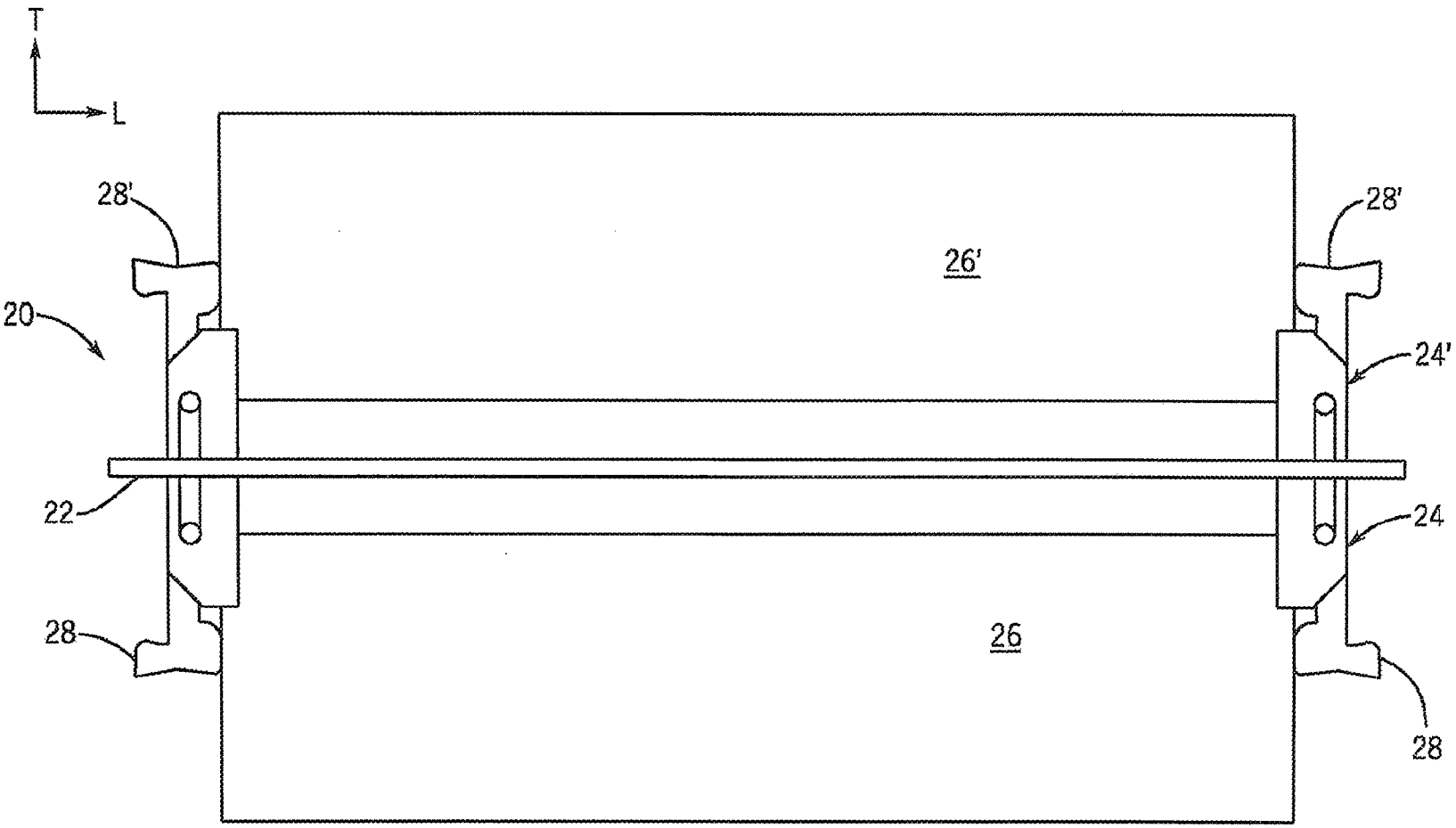
FIG. 9 is a side elevation view of the midplane connector assembly illustrated in FIG. 1.
Figure 10:
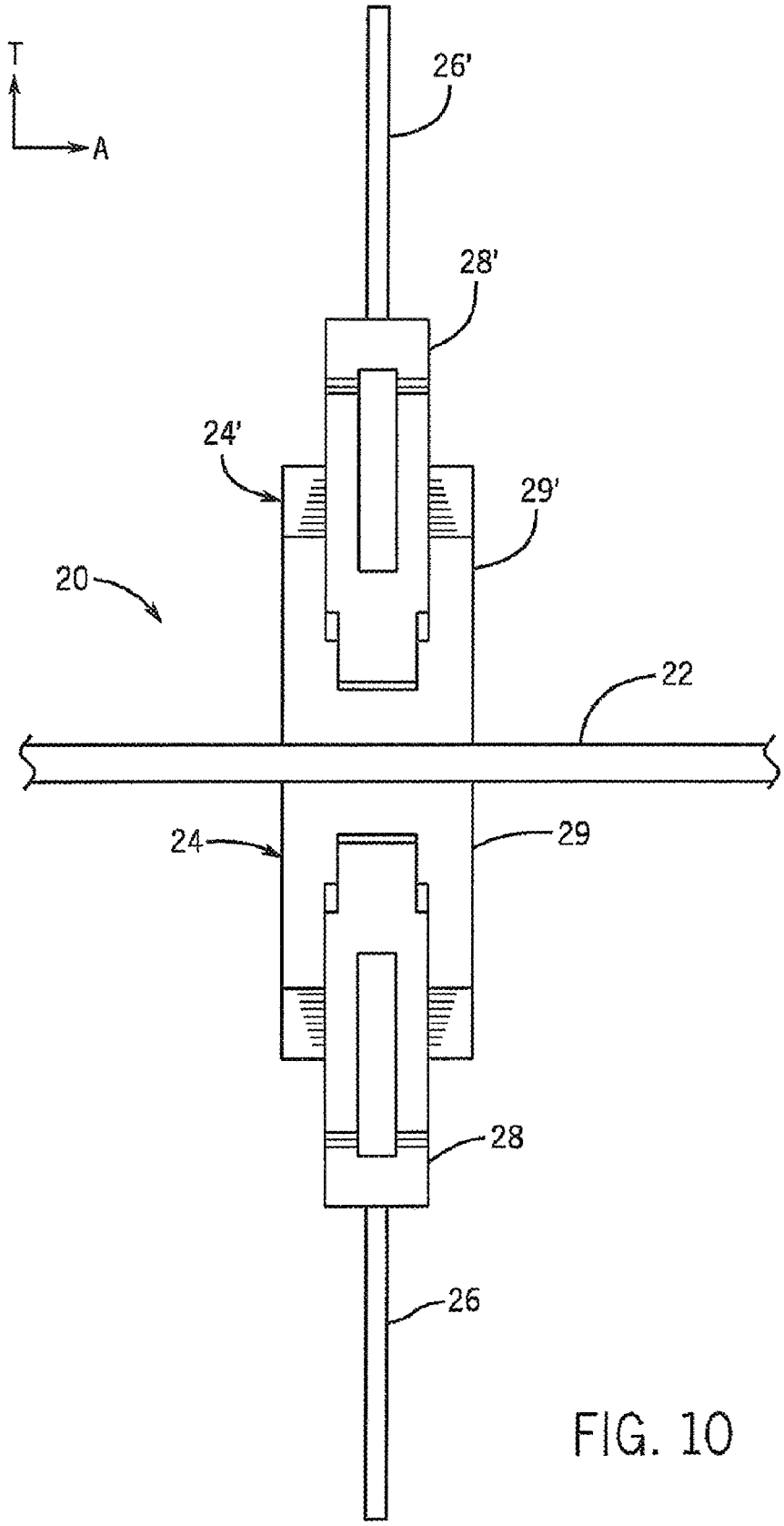
FIG. 10 is an end elevation view of the midplane connector assembly illustrated in FIG. 1.

Referring now to FIGS. 9 and 10, the connectors 24 and 24' are illustrated as being attached to the midplane circuit board 22 in an aligned, or back-to-back, orientation, such that the connectors 24 and 24' are at least partially aligned with respect to the lateral direction A, the longitudinal direction L, or both. In the illustrated embodiment, the connectors 24 and 24' are substantially aligned or fully aligned with respect to both the lateral direction A and the longitudinal direction L. In one example, the slot 40 of the connector 24 is laterally and longitudinally aligned with the corresponding slot of the connector 24'. Accordingly, the connectors 24 and 24' can occupy the same or similar (for instance, within tolerance) footprints on opposing sides of the midplane circuit board 22.

In accordance with another aspect of the present invention, the engagement member 48 of at least one connector 24 or both of the connectors 24 and 24' is aligned with the opposing connector. For instance, in the illustrated embodiment, the connectors 24 and 24' are illustrated as being mounted onto the midplane circuit board 22 such that the engagement member 48' of the connector 24' (see FIG. 8) is laterally and longitudinally aligned with the base 37 of the corresponding latch housing 29 of connector 24, while the engagement member 48 is aligned with the base of one of the latch housings 29' of the opposing connector 24'.

Referring again to FIG. 3 and 4, the connector assembly 20 is configured to reliably secure the connectors 24 and 24' to the midplane circuit board 22 when the connectors are mounted to the midplane circuit board in the back-to-back orientation. Specifically, each of the pair of engagement members 48 of the connector 24 is attached to opposing latch housings 29 at opposing longitudinal ends 42 of the connector 24. Each engagement member 48 is thus longitudinally spaced, or laterally offset, with respect the other engagement member 48. Furthermore, each engagement member 48' is laterally spaced, or longitudinally offset, with respect to the other engagement member 48'. When the connectors 24 and 24' are mounted onto the midplane circuit board 22, the engagement members 48 and 48' are disposed laterally adjacent to each other.

As illustrated, each engagement member 48 is supported by the latch housing 29, and accordingly also the chassis 30, at a location that is disposed at opposing sides of a longitudinal centerline L-L that extends centrally along the connector 24 and thus laterally bisects the connector 24. Each of the pair of posts 68 and 69 of a given latch housing 29 is longitudinally aligned with a corresponding pair of posts 68 and 69 of the opposing latch housing 29 of the connector 24. The post 68 that carries one of the engagement members 48 is longitudinally offset with respect to the post 68 of the opposing latch housing 29 that carries the other engagement member 48, while the other posts 69 are similarly longitudinally offset with respect to each other.

Figure 11:
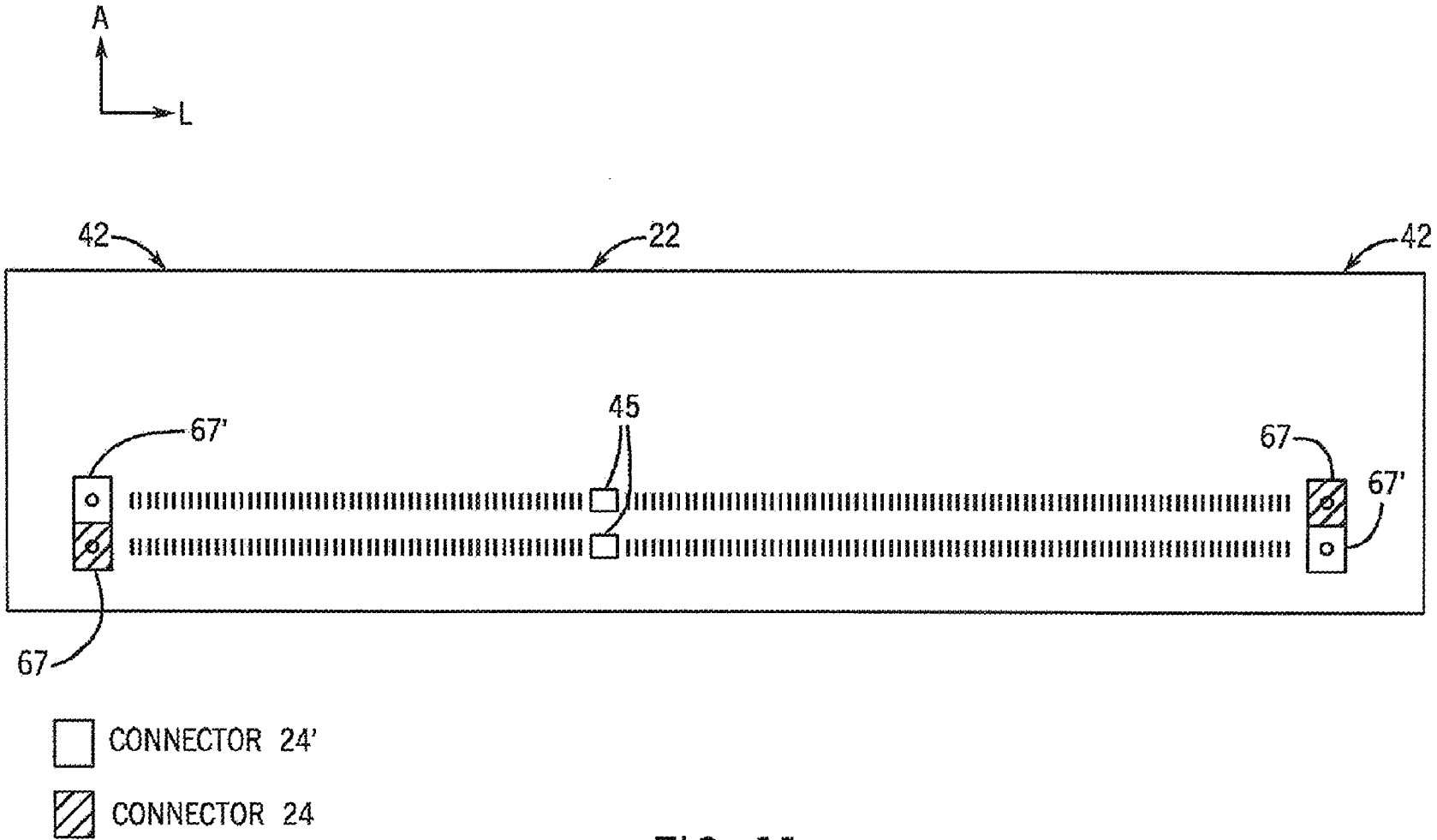
FIG. 11 is a schematic top plan view of the midplane circuit board illustrated in FIG. 1, showing connection locations for the electrical connectors.

Accordingly, referring now to FIG. 11, the midplane circuit board 22 defines a plurality of engagement locations 67 and 67' for each connector 24 and 24', respectively. In particular, the midplane circuit board 22 at each longitudinal end 42 defines a pair of adjacent laterally spaced and longitudinally offset engagement locations 67 and 67' for the connector 24 and the connector 24', respectively. Each engagement location 67 at one longitudinal end 42 is longitudinally aligned with the engagement location 67' at the opposing longitudinal end 42. Furthermore, engagement locations 67 and 67' are arranged in pairs, and are laterally spaced with respect to each other. Accordingly, when the connectors 24 and 24' are attached to the midplane circuit board 22 in a back-to-back orientation, the corresponding engagement members 48 and 48' are offset and removed from interference with each other. Because the connectors 24 and 24' are similarly constructed, and include offset engagement members 48 and 48', the connectors 24 and 24' can be interchangeable and can be easily replaced. In accordance with certain aspects of the present invention, each connector 24 and 24' can be mounted onto either surface 23 or 23' of the midplane circuit board 22.

It should be appreciated that while the engagement locations 67 and 67' (and corresponding engagement members 48 and 48') are offset with respect to one direction (e.g., the longitudinal direction L), the engagement locations 67 and 67' (and corresponding engagement members 48 and 48') could alternatively or additionally be offset with respect to the lateral direction A. It can thus be said that the engagement locations 67 and 67' (and engagement members 48 and 48') are offset with respect to at least one direction. Furthermore, the connector assembly 20 has been described in combination with a pair of engagement locations 67 (and a corresponding pair of engagement members 48) and a pair of engagement locations 67' (and a corresponding pair of engagement members 48'), it should be appreciated that the midplane circuit board 22 could alternatively be connected to each connector 24 and 24' at only one engagement location. Alternatively, the midplane circuit board 22 could be connected to each connector 24 and 24' at three or more connection locations. At least one of the connection locations, including some or all of the engagement members, can be offset in the manner described above.

It should be further appreciated that while the engagement members 48 and 48' are disposed at the end portions 42 and 42' of the respective connectors 24 and 24' in accordance with the illustrated embodiment, the present invention contemplates alternative arrangements whereby the engagement members are disposed anywhere along their respective connectors. The engagement locations 67 and 67' can be disposed on the midplane circuit board 22 at any desired location configured to mate with the engagement members 48 and 48'.

Figure 12:
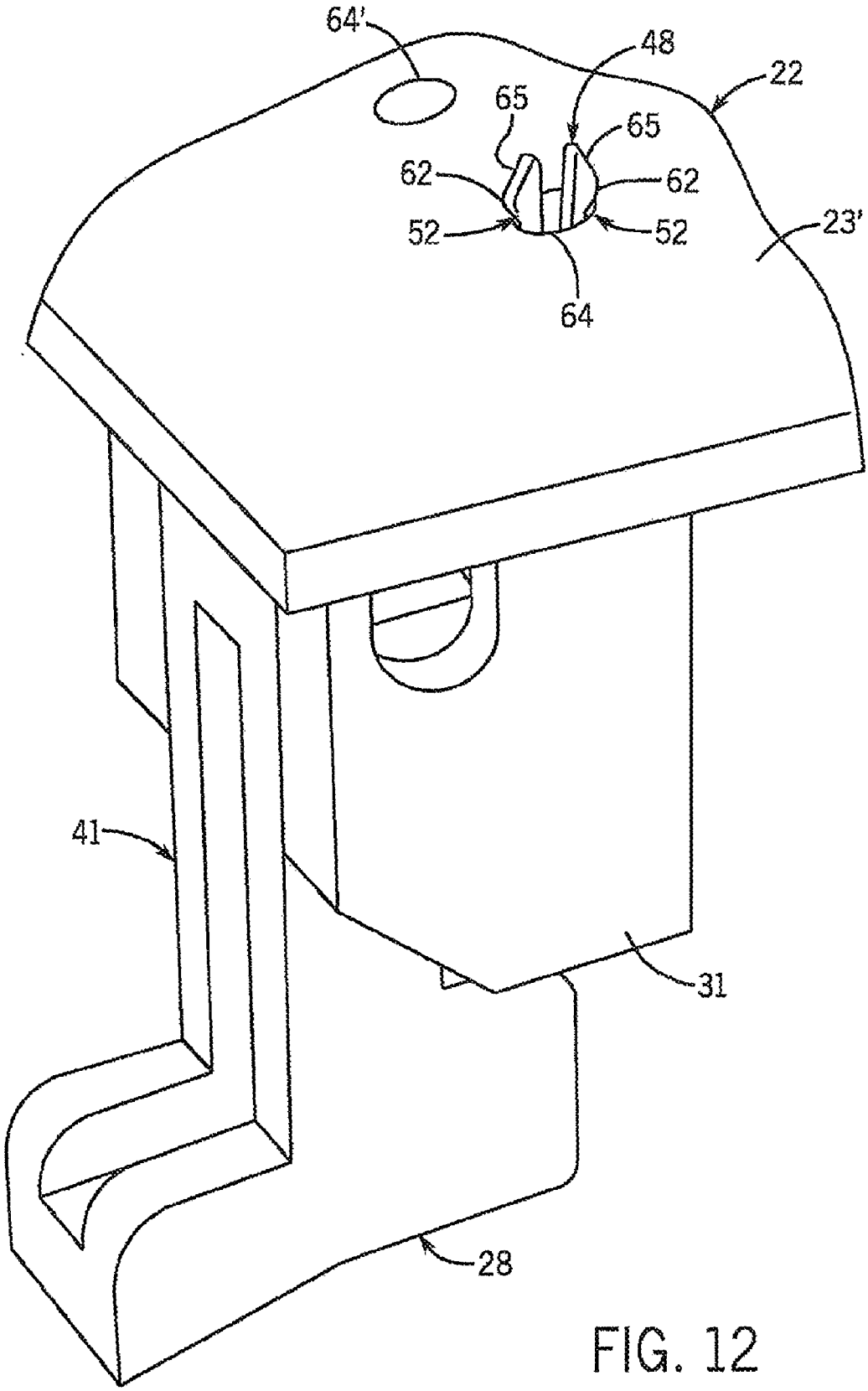
FIG. 12 is a perspective view showing one of the electrical connectors attached to the midplane circuit board in accordance with an alternative embodiment.

Furthermore, while at least one engagement member 48 has been described as mating with an engagement location 67 on the midplane circuit board in accordance with one illustrated embodiment, the present invention recognizes that the connectors 24 and 24' could be attached to the midplane circuit board 22 in one of numerous alternative embodiments. For instance, referring to FIG. 12, the stem 58 of each engagement pin 52 can have a length substantially equal to the transverse thickness of the midplane circuit board 22 such that at least a portion of the barb 62 projects out from the opposing surface 23' of the midplane circuit board 22. As a result, the first edge 63 of each pin 52 interferes with the surface 23' to secure the attachment between the connector and the midplane circuit board 22.

Figure 13:
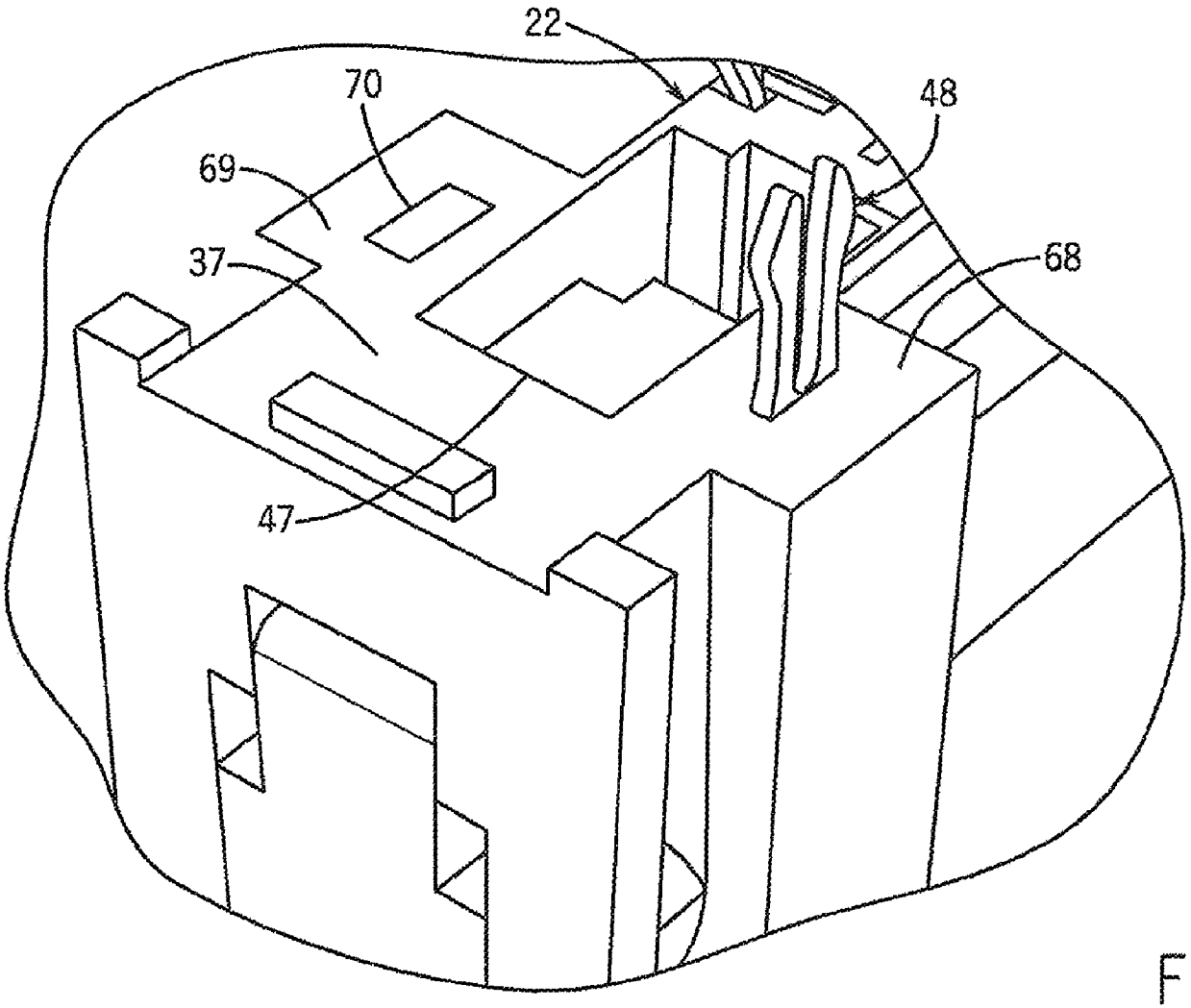
FIG. 13 is a perspective view of a portion of the electrical connector illustrated in FIG. 12.

Referring now to FIG. 13, because the pins 52 project through the midplane circuit board 22, and because the pins 52 of one engagement member 48 are aligned with the posts 69' of the opposing connector 24', an aperture 70 can extend vertically into the posts 69'. The aperture 70 can be rectangular as illustrated, or can be round or any suitable shape sized to receive the portion of the barb 62 that protrudes out from surface 23' of the midplane circuit board 22. As a result, the protruding barb 62 does not interfere with the opposing connector 24'.

Figure 14:
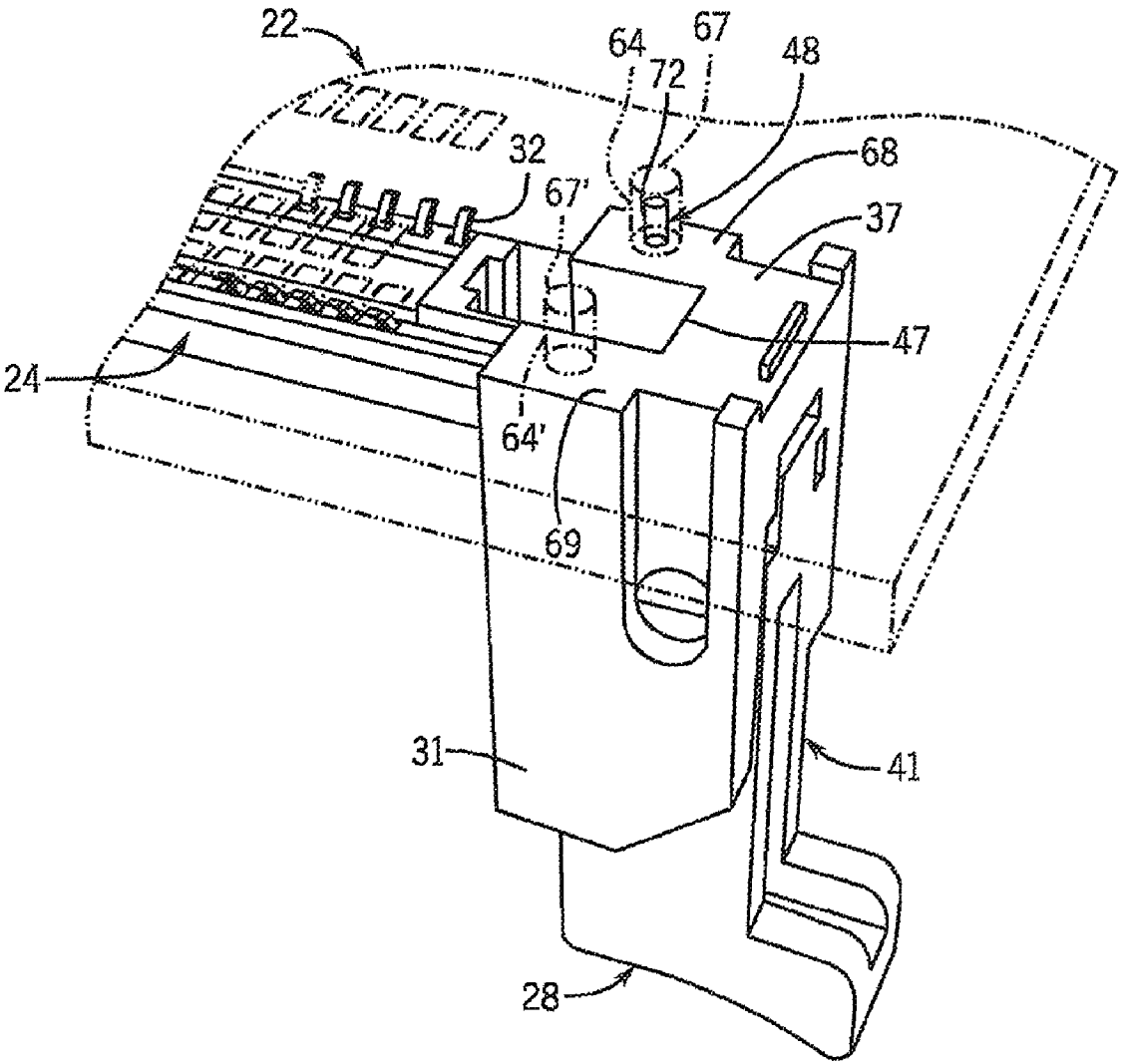
FIG. 14 is a perspective view similar to FIG. 7, but showing the engagement member of the connector constructed in accordance with another alternative embodiment.

Referring now to FIG. 14, the engagement member 48 of connector 24 (and thus also the engagement member of connector 24') can be constructed in accordance with another alternative embodiment. Specifically, as illustrated, the engagement member 48 can be in the form of an engagement pin 72 that extends up from the post 68. The pin 72 can be attached to the post 68 using an epoxy or other mechanical fastener, or can be integrally formed with the connector 24, or can alternatively be inserted into an opening extending into the post 68 in the manner described above with respect to the engagement pins 52.

The pin 72 can be cylindrical as illustrated, or can assume any size and/or shape suitable for insertion into the corresponding aperture 64. As illustrated, the pin 72 is sized having a diameter or other dimension less than that of the aperture 64 such when the pin 72 is inserted into the corresponding aperture 64, the pin 72 loosely engages the aperture 64. When the pin 72 is inserted into the aperture 64, the connector 24 is capable of moving laterally and longitudinally with respect to the midplane circuit board 22. As a result, the loose engagement between the pin 72 and the aperture 64 allows for adjustments to be made when aligning the electrical contacts 32 on the connector 24 with the complementary electrical traces on the midplane circuit board 22.

While the engagement member 48 has been illustrated as a single pin 72 in FIG. 14, it should be appreciated that a plurality of pins 72 could be provided that are cumulatively smaller than the aperture 64 so as to allow for relative movement between the connector 24 and relative to the midplane circuit board 22.

Figure 15:
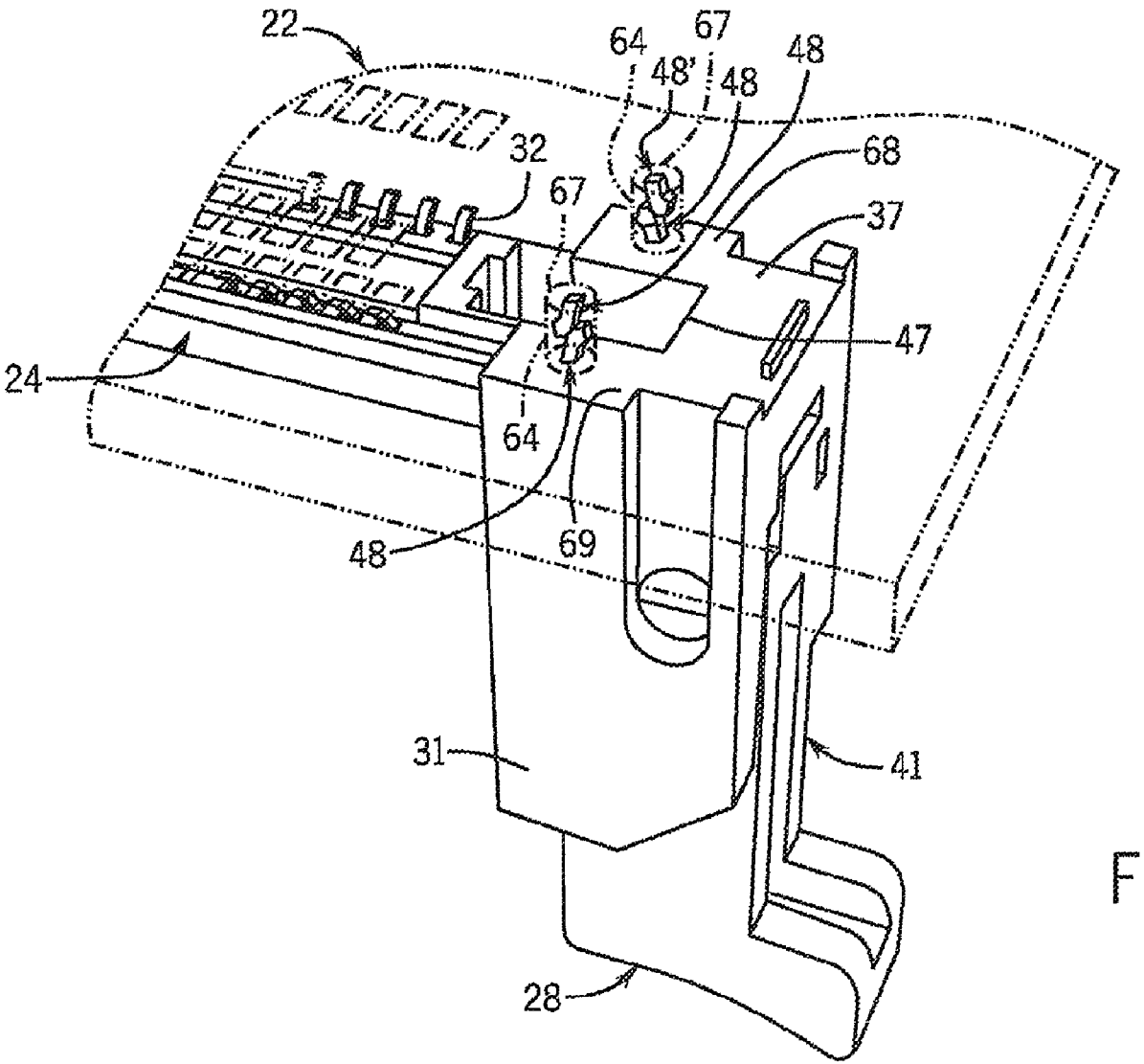
FIG. 15 is an enlarged perspective view of an outer end of the connector as illustrated in FIG. 8 but constructed in accordance with an alternative embodiment.

In accordance with an alternative embodiment, the engagement members 48 and 48' of the connectors 24 and 24' can be aligned or substantially aligned with respect to both the lateral and longitudinal directions and engage a common engagement member 64 so as to attach to the midplane circuit board 22. In particular, as illustrated in FIG. 15, each connector 24 and 24' can include a pair of laterally spaced engagement members 48 and 48' at one or both of its longitudinal ends (or at any alternative location of the connector). The engagement members 48 of connector 24 are thus laterally and longitudinally aligned with the engagement members 48' of connector 24'. The aligned engagement members 48 and 48' are thus configured to extend through a common engagement member 64 which is illustrated as an aperture extending through the midplane circuit board 22 at the engagement location 67.

Figure 16A:
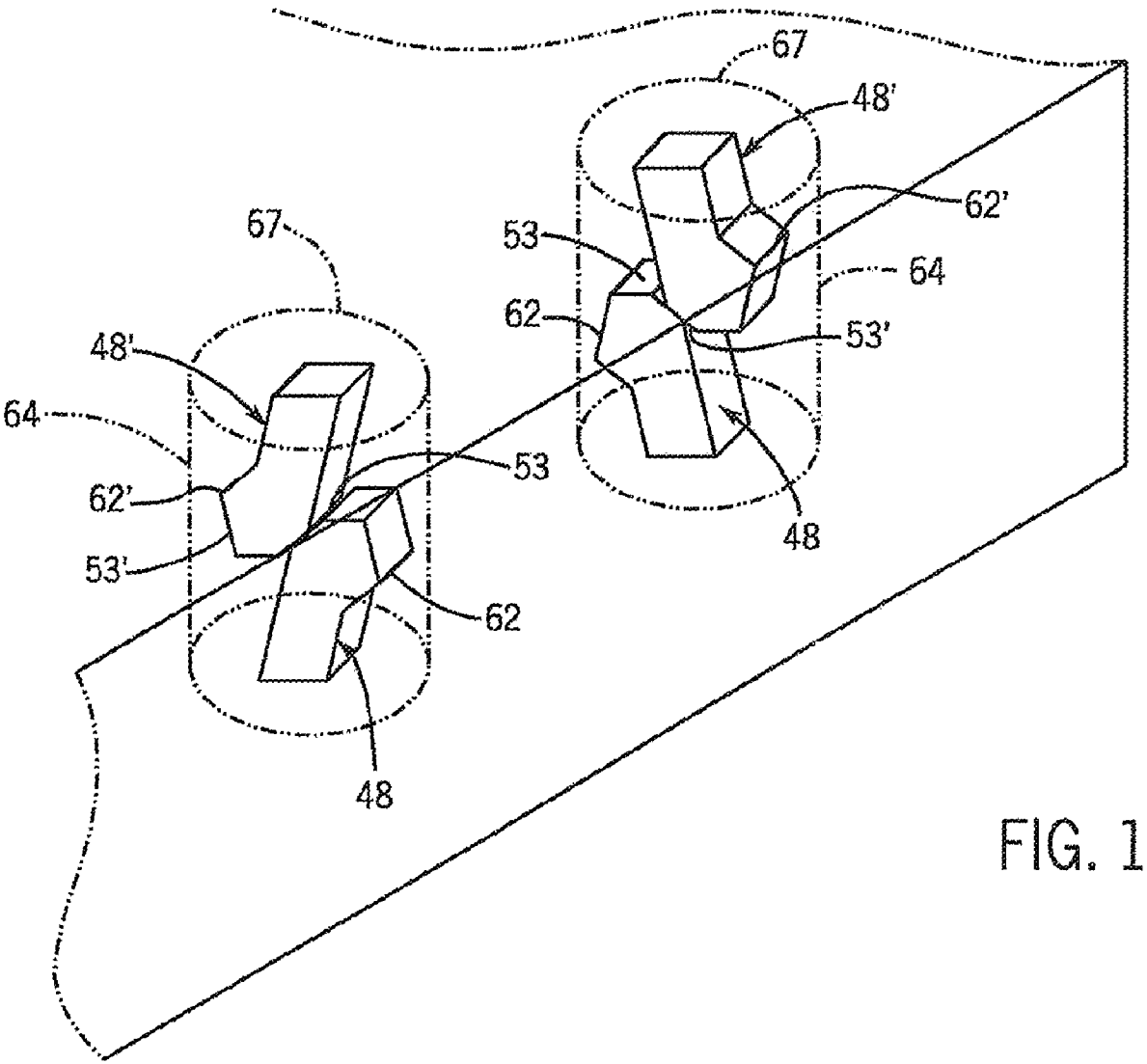
FIG. 16A is an enlarged perspective view showing a pair of connectors engaging the midplane circuit board in accordance with one embodiment.

The engagement members 48 and 48' can engage a common engagement member 64 in any manner appreciated by one having ordinary skill in the art. For instance, as shown in FIG. 16A, the engagement members 48 and 48' can be barbed and attach to the midplane circuit board 22 inside the engagement member 64 in the manner described above. In the illustrated embodiment, each engagement member 48 and 48' defines a beveled mating wall 53 and 53' that allow the engagement members to slide past each other so that the barbs engage the midplane circuit board 22. Alternatively, the aligned or substantially aligned engagement members 48 and 48' can have vertical lengths that are sufficiently small such that the engagement members 48 and 48' do not overlap each other, in which case aperture defined by the engagement member 64 can be bifurcated into a pair of aligned apertures that each receive one of the aligned or substantially aligned engagement members 48 and 48'.

Figure 16B:
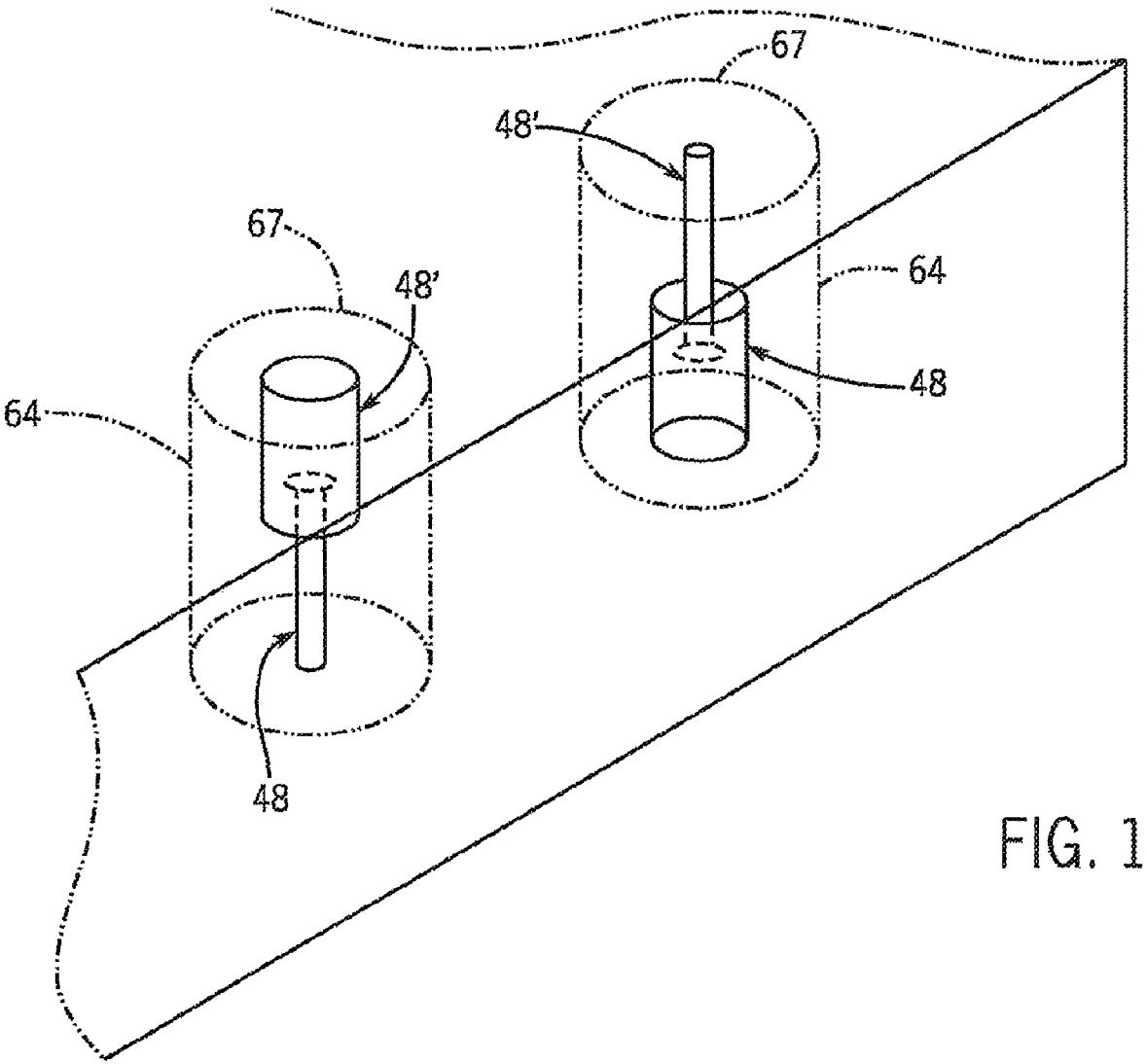
FIG. 16B is an enlarged perspective view showing a pair of connectors engaging the midplane circuit board in accordance with an alternative embodiment.

Alternatively, or additionally, the engagement members 48 and 48' can extend inside the common engagement member 64 and attach to each other as illustrated in FIG. 16B. In the illustrated embodiment, one of the engagement members 48 can attach within the complementary engagement member 48', while another engagement member 48 can receive the complementary engagement member 48'. The protruding engagement members 48 and 48' can have a compliant tip that is configured to lock within a corresponding aperture in the complementary receiving engagement member. Alternatively still, the engagement members 48 and 48' can be provided in the form of an engagement pin 72 in the common engagement member 64 in the manner described above. Whether the engagement members 48 and 48' are configured to attach to a common engagement member 64, attach to each other within a common engagement member 64, or are merely disposed within a common engagement member 64, they can be referred to as "engaging" the engagement member 64.

In this regard, it should be appreciated that the engagement members 48 and 48' can be in lateral and longitudinal alignment, or can be slightly offset in one or both of the lateral and longitudinal directions. Engagement members that are slightly offset yet still engage the midplane circuit board 22 at a common engagement location, or engage a common engagement member 64, can be referred to as substantially aligned.

Figure 17:
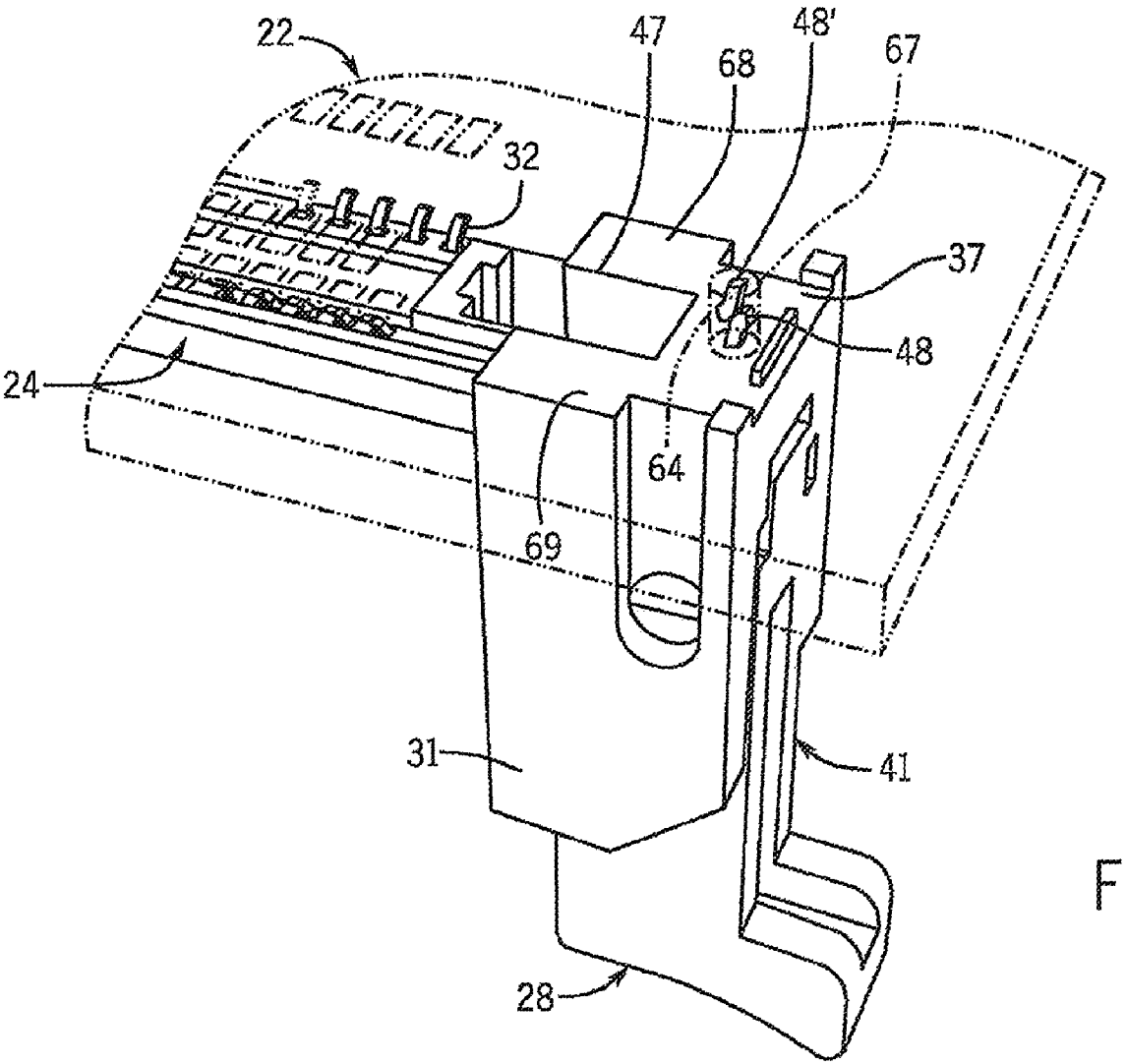
FIG. 17 is an enlarged perspective view of an outer end of the connector as illustrated in FIG. 15, but constructed in accordance with another alternative embodiment.

As described above, the engagement members 48 and 48' of each connector 24 and 24' can engage a common engagement member 64 of the midplane circuit board 22 at any location along the connectors. For instance, the engagement members 48 and 48' can be laterally centrally disposed at each longitudinal end of the corresponding connector 24 and 24' as illustrated in FIG. 17. The engagement members 48 and 48' can engage the engagement member 64 of the midplane circuit board 22 in any manner described above.

Figure 18A:
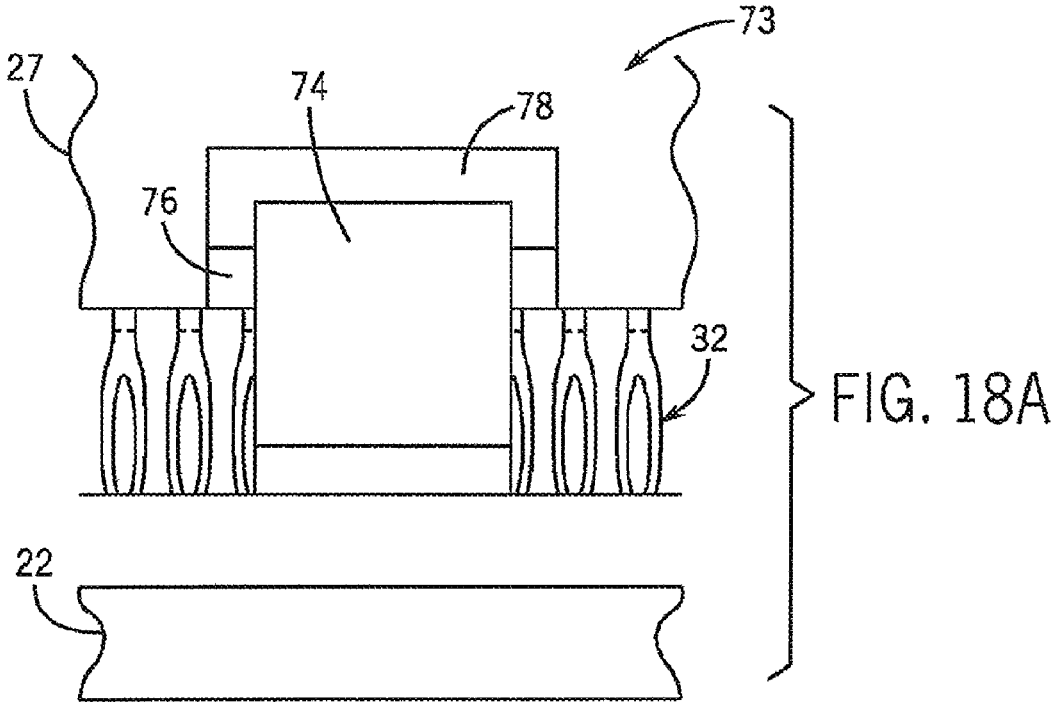
FIG. 18A is a partial side elevation view of the midplane connector assembly illustrated in FIG. 1 including a stability system including a collapsible leg constructed in accordance with one embodiment of the present invention.
Figure 18B:
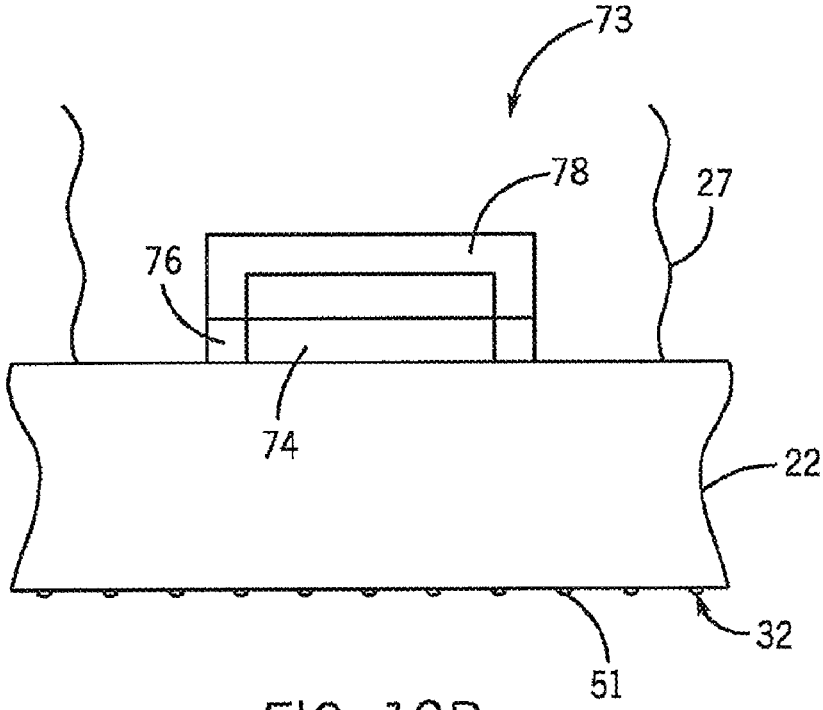
FIG. 18B is a partial side elevation view of the stability system illustrated in FIG. 18A, but showing the connector attached to the midplane circuit board.

Referring now to FIGS. 18A-B, certain aspects of the present invention recognize that the connector assembly 20 as described herein can include a stabilization system 73 that can assist in attaching the connectors 24 and 24' to the midplane circuit board 22. In particular, the connector 24 can include a collapsible leg 74, which can be provided as a protrusion extending vertical from the connector 24 toward the midplane circuit board 22.

The collapsible leg 74 may be made of, for example, a polymer such as plastic, thermoplastic, or the like. The collapsible leg 74 may be fixedly attached to the bottom of the connector housing 27 using, for example, an epoxy material. Alternatively, the collapsible leg 74 and the connector housing 27 may be formed from a single piece of molded polymer using manufacturing techniques such as injection molding, for example. The collapsible leg 74 may be positioned to prevent the electrical connector 24 from tipping in at least one direction relative to the midplane circuit board 22 before the engagement member(s) 48 are attached to the engagement members 64 of the circuit board 22. For example, the collapsible leg 74 may be positioned offset from the center of gravity to provide stability to the electrical connector 24. Additionally, the collapsible leg 74 may be positioned closer to the one end of the connector housing 27 than the engagement members 48 so as to balance the connector housing 27 during transport to a pressing area.

For example, the collapsible leg 74 may rest on the midplane circuit board 22, thereby acting as a back stop should the connector 24 begin to topple during manufacture of the connector assembly 20. Additionally, because the collapsible leg 74 may rest on the circuit board 22, space may be conserved on the circuit board 22 that can thus used to route signals to and from associated electrical devices, for example.

The collapsible leg 74 may be attached to the connector housing 27 using a fastener 76 such as polymer such as plastic, thermoplastic, or the like. The connector housing 27 may also include a recess 78 that extends into the midplane circuit board-engaging surface of the housing 27. The fastener 76 may provide an interference fit for the collapsible leg 74 such that when the electrical connector 24 is pressed to a seated position against the midplane circuit board 22, the collapsible leg 74 may be forced to reside securely in the recess 78. The collapsible leg 74 may remain attached to the connector housing 27 after being pressed to a seated position, thereby eliminating debris.

Figure 19A:
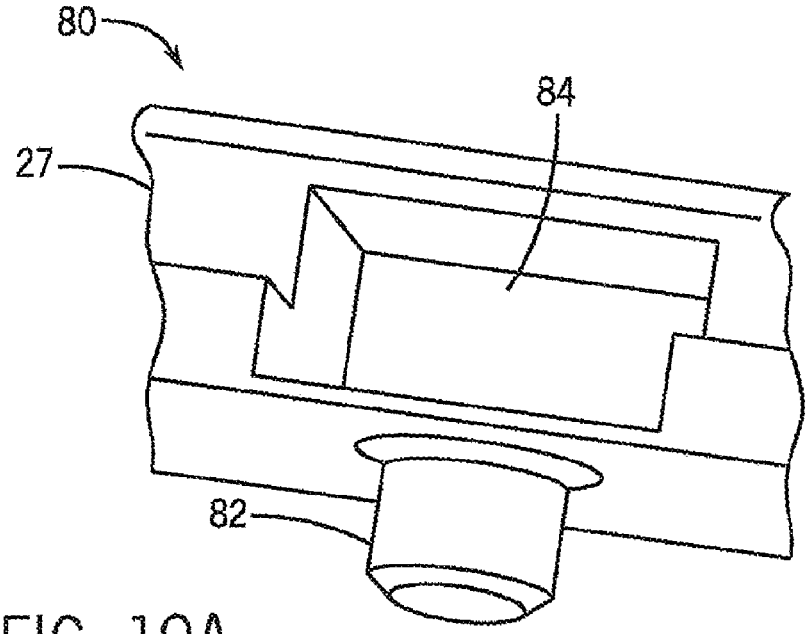
FIG. 19A is a partial side sectional view of a stability system having a collapsible leg constructed in accordance with an alternative embodiment.
Figure 19B:
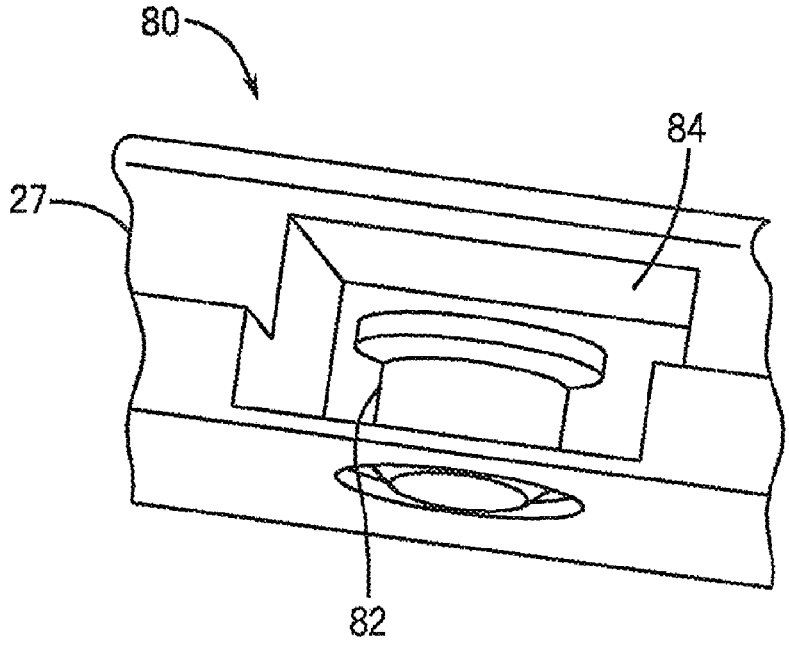
FIG. 19B is a partial side elevation view of the stability system illustrated in FIG. 19A, but showing the collapsible leg in a collapsed configuration.

While one embodiment of a stabilization system has been described with respect to FIGS. 18A-B, the present invention recognizes that any suitable stabilization system can be used in combination with the connector assembly 20. One such alternative stabilization system 80 is illustrated in FIGS. 19A-B.

In particular, the stabilization system 80 can include a collapsible peg 82 that can be provided as a protrusion from the connector housing 27. The collapsible peg 82 can be made from, for example, a polymer such as plastic, thermoplastic, or the like. The collapsible peg 82 may be fixedly attached to the bottom of the connector housing 27 using, for example, an epoxy material or any suitable mechanical fastener. The connector housing 27 can include a cored recess 84 such that the collapsible peg 82 may be disposed below and in vertical alignment with the recess 84. Additionally, the collapsible peg 82 and the corresponding recess 84 may be positioned to impede the electrical connector from tipping in at least one direction relative to the substrate 400. For example, the collapsible peg 82 and the recess 84 can be disposed at a position offset from the center of gravity of the associated electrical connector to provide stability to the connector.

After being transported to the pressing area, the electrical connector may be seated onto the midplane circuit board 22 in the manner described above with reference to FIGS. 18A-B. Specifically, when the electrical connector is pressed into a seated position against the midplane circuit board, the collapsible peg 82 may break at its base. Upon further pressure, the collapsible peg 82 may be pushed into the recess 84 resulting in interference that secures the collapsible peg 82 into the recess 84. Thus, the collapsible peg 82 can be contained in the recess 84 by the midplane circuit board, thereby eliminating debris.

The present invention has been illustrated by the description of several embodiments. The present invention, however, is not limited to the particular embodiments described herein. Rather the present invention encompasses any combination of the features of any of the embodiments and natural variations thereof, as will be understood by persons familiar with electrical connectors.

What is claimed:

1. An electrical connector configured to be attached to a midplane circuit board, the electrical connector comprising a chassis that is elongate in a longitudinal direction and that further extends along a lateral direction perpendicular to the longitudinal direction, the chassis defining a slot, the slot being configured to receive an edge of an electrical component;

a plurality of electrical contacts configured to be electrically connected between the electrical component and the midplane circuit board; and first and second engagement members extending out from the chassis in a transverse direction orthogonal to the longitudinal and lateral directions, wherein the engagement members are offset with respect to both the longitudinal and lateral directions, such that no additional engagement members extend from the chassis at a position longitudinally outward from the first and second engagement members.

2. The electrical connector as recited in claim 1, wherein each engagement member comprises a stem extending from the chassis and a barb protruding from the stem.

3. The electrical connector as recited in claim 2, wherein each engagement member comprises a pair of the retention pins joined at their stems and having a relaxed position, and each pin is flexible so as to move from the relaxed position to a flexed position.

4. The electrical connector as recited in claim 1, wherein each engagement member comprises at least one stem configured to be loosely inserted into a corresponding engagement location of the midplane circuit board.

5. The electrical connector as recited in claim 1, further comprising a first post that supports the first engagement member, and a second post spaced laterally with respect to the first post, wherein an aperture extends into the second post, the aperture being sized to receive at least a portion of the first engagement member.

6. The electrical connector as recited in claim 1, wherein the electrical component comprises a data double rate memory module assembly.

7. A midplane connector assembly comprising:

a first electrical connector and a second electrical connector each configured to be mounted onto a midplane circuit board in a back-to-back orientation, wherein the first and second electrical connectors each include:

a chassis that is elongate in a first direction and further extends in a second direction perpendicular to the first direction;

a plurality of electrical contacts supported by the chassis and configured to be electrically connected between the midplane circuit board and an electrical component; and a first engagement member, a second engagement member, and no other board engagement members, wherein each engagement member is configured to extend into the midplane circuit board, and the first and second engagement members are spaced from each other with respect to both the first and second directions.

8. The electrical connector assembly as recited in claim 7, wherein each electrical connector defines a slot that is configured to receive an edge portion of the electrical component.

9. The electrical connector assembly as recited in claim 8, wherein the slot of the first electrical connector is at least substantially aligned with the slot of the second electrical connector with respect to the first and second directions.

10. The electrical connector assembly as recited in claim 7, wherein the electrical component comprises a double data rate memory module assembly.

11. The electrical connector assembly as recited in claim 7, wherein at least one of the engagement members of one the first and second connectors is substantially aligned with at least one of the engagement members of the other of the first and second connectors, such that the aligned engagement members are adapted to be received by a common aperture extending through the midplane circuit board.

12. The electrical connector assembly as recited in claim 11, wherein the engagement members of the connectors each define a distal end that is configured to extend through the midplane circuit board, and the first and second electrical connectors define an aperture extending therein that is sized to receive the distal end of the other electrical connector.

13. The electrical connector assembly as recited in claim 7, further comprising:

an alignment post that extends from the chassis, the alignment post being configured to be received in an aperture defined by the midplane circuit board; and a protrusion that extends from the chassis, the protrusion being adapted to impede the connector from tipping in at least one direction relative to the midplane circuit board when the first alignment post is at least partially received into the aperture.

14. The midplane connector assembly as recited in claim 7, wherein when the first and second electrical connectors are mounted onto the midplane circuit board, the first and second engagement members of each connector are spaced from each other only along the second direction.

15. The midplane connector assembly as recited in claim 7, wherein each engagement member is configured to extend into the midplane circuit board.

16. The midplane connector assembly as recited in claim 7, wherein the first and second directions of each connector extend parallel to respective first and second faces of the midplane circuit board to which the connectors are configured to be mounted, and each engagement member extend in a third direction that is orthogonal with respect to the first and second directions.

17. The electrical connector assembly as recited in claim 15, wherein the first engagement member of the first connector is offset in two directions with respect to the second engagement member of the first connector, and the first engagement member of the second connector is offset in two directions with respect to the second engagement member of the second connector.

18. The electrical connector assembly as recited in claim 15, wherein the first and second electrical connectors comprise no engagement members other than the first and second engagement members.

19. The electrical connector assembly as recited in claim 15, wherein the first and second electrical connectors comprise a chassis having a portion that interfaces with the midplane circuit board when the electrical connectors are mounted onto the midplane circuit board, wherein the portion of the chassis of the first electrical connector is identical with respect to the portion of the chassis of the second electrical connector.

20. An electrical connector assembly comprising:

a first electrical connector and a second electrical connector each having opposing first and second outer ends and configured to be mounted onto the midplane circuit board in a first back-to-back orientation whereby the first outer ends and the second outer ends of the electrical connectors are aligned, and a second back-to-back orientation whereby the first outer end of the first electrical connector is aligned with the second outer end of the second electrical connector and the second outer end of the first electrical connector is aligned with the first outer end of the second electrical connector, wherein the first and second electrical connectors each include a plurality of electrical contacts, and each of the first and second electrical connectors include respective first and second engagement members configured to engage the midplane circuit board, such that the engagement members of the first electrical connector are offset with respect to the engagement members of the second electrical connector regardless of whether the electrical connectors are mounted to the midplane circuit board in the first or second back-to-back orientation.

21. The electrical connector assembly as recited in claim 20, further comprising the midplane circuit board connected between the first and second electrical connectors.

* * * * *